US010455321B2

(12) United States Patent
Bernal Castillo et al.

(10) Patent No.: US 10,455,321 B2
(45) Date of Patent: Oct. 22, 2019

(54) MICROPHONE CONFIGURATIONS

(71) Applicant: QUALCOMM Incorporated, San Diego, CA (US)

(72) Inventors: Ricardo De Jesus Bernal Castillo, San Diego, CA (US); Wade Heimbigner, Vista, CA (US); Dipanjan Sen, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 15/727,334

(22) Filed: Oct. 6, 2017

(65) Prior Publication Data

US 2018/0317002 A1 Nov. 1, 2018

Related U.S. Application Data

(60) Provisional application No. 62/492,106, filed on Apr. 28, 2017.

(51) Int. Cl.

| | |
|---|---|
| ***H04R 1/08*** | (2006.01) |
| ***H04R 9/08*** | (2006.01) |
| ***H04R 11/04*** | (2006.01) |
| ***H04R 1/32*** | (2006.01) |
| ***H04R 1/02*** | (2006.01) |

(Continued)

(52) U.S. Cl.

CPC ..... *H04R 1/326* (2013.01); *H04R 1/021* (2013.01); *H04R 1/08* (2013.01); *H04R 1/406* (2013.01); *H04R 3/005* (2013.01); *H04R 3/02* (2013.01); *H04R 5/027* (2013.01); *H04R 2201/401* (2013.01); *H04R 2410/01* (2013.01);

(Continued)

(58) Field of Classification Search

CPC ..... H04R 19/005; H04R 1/08; H04R 9/08; H04R 11/04; H04R 17/02; H04R 21/02

USPC ..... 381/355–358, 369, 175

See application file for complete search history.

(56) References Cited

U.S. PATENT DOCUMENTS 5,715,319 A * 2/1998 Chu ..... H04R 3/005 381/26

7,092,539 B2 8/2006 Sheplak et al.

(Continued)

FOREIGN PATENT DOCUMENTS

EP 2988527 A1 2/2016
EP 3145213 A1 3/2017

OTHER PUBLICATIONS

Kobayashi K., et al., "Estimation of Multiple Talker Locations Using Randomly Positioned Microphones (Method of Subarray Selection)", Electronics and Communications in Japan, Scripta Technica, New York, US, Jun. 1, 2001, vol. 84, No. 9, Part 03, XP001063555, DOI: 10.1002/ECJC.1 033, pp. 42-48.

(Continued)

*Primary Examiner* — Suhan Ni

(74) *Attorney, Agent, or Firm* — Qualcomm Incorporated—Toler

(57) ABSTRACT

A microphone device includes a microphone array configured to capture one or more audio objects associated with a three-dimensional sound field. The microphone array includes clusters of two or more microphone elements. Each cluster includes one or more acoustic port openings and two or more microphone elements coupled to the one or more acoustic port openings via corresponding acoustic ports. The microphone device also includes a processor coupled to the microphone array.

30 Claims, 15 Drawing Sheets

(51) Int. Cl.

| | |
|---|---|
| ***H04R 5/027*** | (2006.01) |
| ***H04R 1/40*** | (2006.01) |
| ***H04R 3/00*** | (2006.01) |
| ***H04R 3/02*** | (2006.01) |
| *H04S 7/00* | (2006.01) |

(52) U.S. Cl.
CPC ..... *H04R 2410/03* (2013.01); *H04R 2430/20* (2013.01); *H04S 7/303* (2013.01); *H04S 2400/15* (2013.01)

(56) References Cited

U.S. PATENT DOCUMENTS

| | | | | |
|---|---|---|---|---|
| 7,623,672 | B2 | 11/2009 | Wu et al. | |
| 7,657,025 | B2 * | 2/2010 | Hsu | H04M 1/03 379/429 |
| 7,933,428 | B2 * | 4/2011 | Sawada | H04R 1/406 257/416 |
| 8,649,545 | B2 * | 2/2014 | Tanaka | H04R 1/38 381/355 |
| 8,824,699 | B2 * | 9/2014 | Derkx | G01S 3/8083 381/92 |
| 8,879,767 | B2 * | 11/2014 | Wickstrom | H04R 19/04 381/174 |
| 8,897,455 | B2 * | 11/2014 | Visser | G10L 21/0208 381/26 |
| 8,958,592 | B2 * | 2/2015 | Huang | H04R 1/08 181/144 |
| 8,965,005 | B1 | 2/2015 | Gopalakrishnan et al. | |
| 9,301,033 | B2 * | 3/2016 | Han | H04R 1/406 |
| 9,552,840 | B2 | 1/2017 | Kim et al. | |
| 9,668,055 | B2 | 5/2017 | Baggio et al. | |
| 9,712,936 | B2 | 7/2017 | Peters | |
| 9,888,316 | B2 | 2/2018 | Matheja et al. | |
| 2003/0059061 | A1 | 3/2003 | Tsuji et al. | |
| 2005/0175190 | A1 * | 8/2005 | Tashev | H04R 3/005 381/92 |
| 2006/0280318 | A1 | 12/2006 | Warren et al. | |
| 2007/0177752 | A1 * | 8/2007 | Kargus, IV | H04R 1/38 381/357 |
| 2008/0146289 | A1 | 6/2008 | Korneluk et al. | |
| 2008/0181430 | A1 | 7/2008 | Zhang et al. | |
| 2009/0103704 | A1 | 4/2009 | Kitada et al. | |
| 2010/0086164 | A1 * | 4/2010 | Gong | B81C 1/0023 381/369 |
| 2010/0111340 | A1 | 5/2010 | Miller et al. | |
| 2012/0076316 | A1 | 3/2012 | Zhu et al. | |
| 2012/0328142 | A1 | 12/2012 | Horibe et al. | |
| 2013/0029684 | A1 | 1/2013 | Kawaguchi et al. | |
| 2013/0070951 | A1 * | 3/2013 | Tanaka | H04R 1/38 381/361 |
| 2013/0129136 | A1 | 5/2013 | Harney et al. | |
| 2013/0294616 | A1 | 11/2013 | Mulder | |
| 2014/0105416 | A1 | 4/2014 | Huttunen et al. | |
| 2014/0161295 | A1 * | 6/2014 | Huang | H04R 1/406 381/357 |
| 2014/0358563 | A1 | 12/2014 | Sen et al. | |
| 2015/0003638 | A1 * | 1/2015 | Kasai | H04R 1/08 381/122 |
| 2016/0140949 | A1 | 5/2016 | Fan et al. | |
| 2016/0150325 | A1 * | 5/2016 | Oliaei | H04R 1/406 381/111 |
| 2017/0150255 | A1 | 5/2017 | Wang et al. | |
| 2017/0325038 | A1 | 11/2017 | Yu et al. | |
| 2018/0033447 | A1 | 2/2018 | Ramprashad et al. | |
| 2018/0049660 | A1 | 2/2018 | Sato | |
| 2018/0133583 | A1 | 5/2018 | Tran et al. | |
| 2018/0317006 | A1 | 11/2018 | Heimbigner et al. | |

OTHER PUBLICATIONS

"Eigenmike® microphone: Digital Signal Processing, Acoustics", 2017, 3 Pages.

Sennheiser: "Ambeo® VR Mic", 3D Audio Technology, 2017, 9 Pages.

International Search Report and Written Opinion—PCT/US2018/022361—ISA/EPO—dated Jul. 3, 2018.

* cited by examiner

MICROPHONE CONFIGURATIONS

I. CROSS-REFERENCE TO RELATED APPLICATIONS

The present application claims priority from U.S. Provisional Patent Application No. 62/492,106 filed Apr. 28, 2017, entitled "MULTI-ORDER MICROPHONE CONFIGURATIONS," which is incorporated by reference in its entirety.

II. FIELD

The present disclosure is generally related to a microphone.

III. DESCRIPTION OF RELATED ART

Advances in technology have resulted in smaller and more powerful computing devices. For example, there currently exist a variety of portable personal computing devices, including wireless telephones such as mobile and smart phones, tablets and laptop computers that are small, lightweight, and easily carried by users. These devices can communicate voice and data packets over wireless networks. Further, many such devices incorporate additional functionality such as a digital still camera, a digital video camera, a digital recorder, and an audio file player. Also, such devices can process executable instructions, including software applications, such as a web browser application, that can be used to access the Internet. As such, these devices can include significant computing capabilities.

Wireless devices may include microphone arrays. Each microphone array may include multiple microphones that capture surrounding audio in three-dimensional environments. However, activating each microphone in a microphone array may consume a relatively high amount of energy.

IV. SUMMARY

A higher-order ambisonics (HOA) signal (often represented by a plurality of spherical harmonic coefficients (SHC) or other hierarchical elements) is a three-dimensional representation of a sound field. The HOA signal, or SHC representation of the HOA signal, may represent the sound field in a manner that is independent of local speaker geometry used to playback a multi-channel audio signal rendered from the HOA signal. The HOA signal may also facilitate backwards compatibility as the HOA signal may be rendered to multi-channel formats, such as a 5.1 audio channel format or a 7.1 audio channel format.

In a particular implementation, a microphone device includes a microphone array configured to capture one or more audio objects associated with a three-dimensional sound field. The microphone array includes a first cluster and a second cluster. The first cluster includes a first set of two or more microphone elements and the second cluster includes a second set of two or more microphone elements. The microphone device also includes a processor coupled to the microphone array. The processor is configured to receive directionality information associated with a sound source. The processor is also configured to select a first microphone element configuration for the first cluster based on a condition, the directionality information, or both. Each microphone element of the first set of two or more microphone elements is deactivated in response to selection of the first microphone element configuration.

In another particular implementation, a method includes capturing, at a microphone array, one or more audio objects associated with a three-dimensional sound field. The microphone array includes a first cluster and a second cluster. The first cluster includes a first set of two or more microphone elements and the second cluster includes a second set of two or more microphone elements. The method also includes determining, at a processor, directionality information associated with a sound source. The method further includes selecting a first microphone element configuration for the first cluster based on a condition, the directionality information, or both. Each microphone element of the first set of two or more microphone elements is deactivated in response to selection of the first microphone element configuration.

In another particular implementation, a non-transitory computer-readable medium includes instructions that, when executed by a processor, cause the processor to perform operations including initiating capture, at a microphone array, of one or more audio objects associated with a three-dimensional sound field. The microphone array includes a first cluster and a second cluster. The first cluster includes a first set of two or more microphone elements and the second cluster includes a second set of two or more microphone elements. The operations also include determining directionality information associated with a sound source. The operations further include selecting a first microphone element configuration for the first cluster based on a condition, the directionality information, or both. Each microphone element of the first set of two or more microphone elements is deactivated in response to selection of the first microphone element configuration.

In another particular implementation, an apparatus includes means for capturing one or more audio objects associated with a three-dimensional sound field. The means for capturing includes a first cluster and a second cluster. The first cluster includes a first set of two or more microphone elements and the second cluster includes a second set of two or more microphone elements. The apparatus also includes means for determining directionality information associated with a sound source. The apparatus further includes means for selecting a first microphone element configuration for the first cluster based on a condition, the directionality information, or both. Each microphone element of the first set of two or more microphone elements is deactivated in response to selection of the first microphone element configuration.

In another particular implementation, a microphone device includes a microphone array configured to capture one or more audio objects associated with a three-dimensional sound field. The microphone array includes clusters of two or more microphone elements. Each cluster includes one or more acoustic port openings and two or more microphone elements coupled to the one or more acoustic port openings via corresponding acoustic ports. The microphone device also includes a processor coupled to the microphone array.

In another particular implementation, a method includes capturing, at a microphone array, one or more audio objects associated with a three-dimensional sound field. The microphone array includes clusters of two or more microphone elements. Each cluster includes one or more acoustic port openings and two or more microphone elements coupled to the one or more acoustic port openings via corresponding acoustic ports. The method also includes processing the one or more captured audio objects.

In another particular implementation, an apparatus includes means for capturing one or more audio objects associated with a three-dimensional sound field. The means for capturing includes clusters of two or more microphone elements. Each cluster includes one or more acoustic port openings and two or more microphone elements coupled to the one or more acoustic port openings via corresponding acoustic ports. The apparatus also includes means for processing the one or more captured audio objects.

In another particular implementation, a microphone device includes a microphone array configured to capture one or more audio objects associated with a three-dimensional sound field. The microphone array includes a first cluster of two or more microphone elements and a second cluster of two or more microphone elements. The microphone array also includes an acoustic port opening that is shared by the first cluster and the second cluster. The microphone device also includes a processor coupled to the microphone array.

Other implementations, advantages, and features of the present disclosure will become apparent after review of the entire application, including the following sections: Brief Description of the Drawings, Detailed Description, and the Claims.

V. BRIEF DESCRIPTION OF THE DRAWINGS

VI. DETAILED DESCRIPTION

Figure 1:
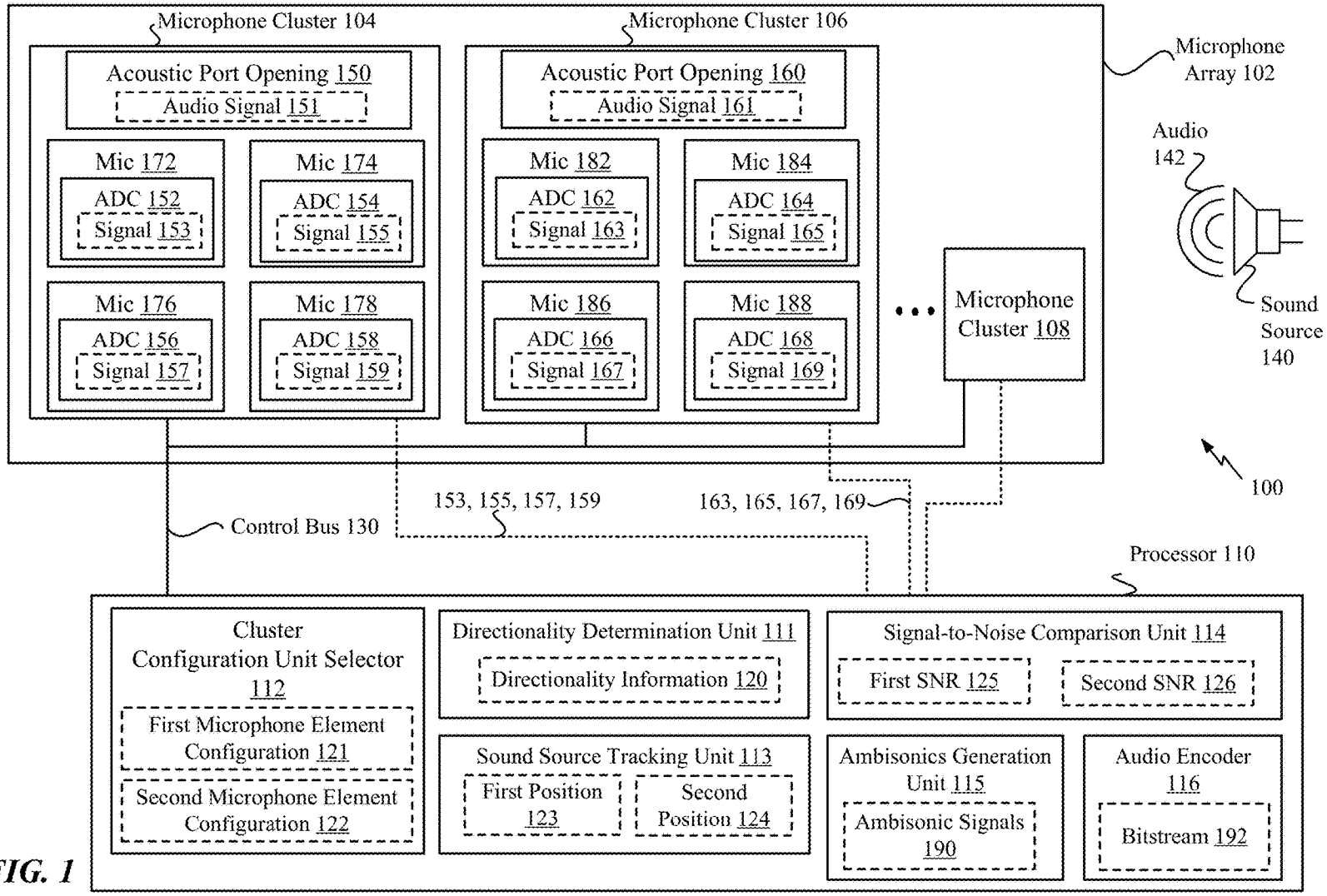
FIG. 1 is a system that is operable to dynamically change a microphone element configuration based on different criteria.

Particular aspects of the present disclosure are described below with reference to the drawings. In the description, common features are designated by common reference numbers. As used herein, various terminology is used for the purpose of describing particular implementations only and is not intended to be limiting of implementations. For example, the singular forms "a," "an," and "the" are intended to include the plural forms as well, unless the context clearly indicates otherwise. It may be further understood that the terms "comprise," "comprises," and "comprising" may be used interchangeably with "include," "includes," or "including." Additionally, it will be understood that the term "wherein" may be used interchangeably with "where." As used herein, "exemplary" may indicate an example, an implementation, and/or an aspect, and should not be construed as limiting or as indicating a preference or a preferred implementation. As used herein, an ordinal term (e.g., "first, " "second," "third," etc.) used to modify an element, such as a structure, a component, an operation, etc., does not by itself indicate any priority or order of the element with respect to another element, but rather merely distinguishes the element from another element having a same name (but for use of the ordinal term). As used herein, the term "set" refers to one or more of a particular element, and the term "plurality" refers to multiple (e.g., two or more) of a particular element.

In the present disclosure, terms such as "determining," "calculating," "estimating," "shifting," "adjusting," etc. may be used to describe how one or more operations are performed. It should be noted that such terms are not to be construed as limiting and other techniques may be utilized to perform similar operations. Additionally, as referred to herein, "generating," "calculating," "estimating," "using," "selecting," "accessing," and "determining" may be used interchangeably. For example, "generating," "calculating," "estimating," or "determining" a parameter (or a signal) may refer to actively generating, estimating, calculating, or determining the parameter (or the signal) or may refer to using, selecting, or accessing the parameter (or signal) that is already generated, such as by another component or device. As used herein, "capturing an audio object" may correspond to capturing a sound signal or generating data representative of a sound signal.

In general, techniques are described for coding of higher-order ambisonics audio data. Higher-order ambisonics audio data may include at least one higher-order ambisonic (HOA) coefficient corresponding to a spherical harmonic basis function having an order greater than one.

The evolution of surround sound has made available many audio output formats for entertainment. Examples of such consumer surround sound formats are mostly 'channel' based in that they implicitly specify feeds to loudspeakers in certain geometrical coordinates. The consumer surround sound formats include the popular 5.1 format (which includes the following six channels: front left (FL), front right (FR), center or front center, back left or surround left, back right or surround right, and low frequency effects (LFE)), the growing 7.1 format, and various formats that includes height speakers such as the 7.1.4 format and the 22.2 format (e.g., for use with the Ultra High Definition Television standard). Non-consumer formats can span any number of speakers (in symmetric and non-symmetric geometries) often termed 'surround arrays.' One example of such a sound array includes 32 loudspeakers positioned at coordinates on the corners of a truncated icosahedron.

The input to a future Moving Picture Experts Group (MPEG) encoder is optionally one of three possible formats: (i) traditional channel-based audio (as discussed above), which is meant to be played through loudspeakers at prespecified positions; (ii) object-based audio, which involves discrete pulse-code-modulation (PCM) data for single audio objects with associated metadata containing their location coordinates (amongst other information); or (iii) scene-based audio, which involves representing the sound field using coefficients of spherical harmonic basis functions (also called "spherical harmonic coefficients" or SHC, "Higher-order Ambisonics" or HOA, and "HOA coefficients").

There are various 'surround-sound' channel-based formats currently available. The formats range, for example, from the 5.1 home theatre system (which has been the most successful in terms of making inroads into living rooms beyond stereo) to the 22.2 system developed by NHK (Nippon Hoso Kyokai or Japan Broadcasting Corporation). Content creators (e.g., Hollywood studios) would like to produce a soundtrack for a movie once, and not spend effort to remix it for each speaker configuration. Recently, Standards Developing Organizations have been considering ways in which to provide an encoding into a standardized bitstream and a subsequent decoding that is adaptable and agnostic to the speaker geometry (and number) and acoustic conditions at the location of the playback (involving a renderer).

To provide such flexibility for content creators, a hierarchical set of elements may be used to represent a sound field. The hierarchical set of elements may refer to a set of elements in which the elements are ordered such that a basic set of lower-ordered elements provides a full representation of the modeled sound field. As the set is extended to include higher-order elements, the representation becomes more detailed, increasing resolution.

One example of a hierarchical set of elements is a set of spherical harmonic coefficients (SHC). The following expression demonstrates a description or representation of a sound field using SHC:

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t},$$

The expression shows that the pressure $p_i$ at any point $\{r_r,\theta_r,\varphi_r\}$ of the soundfield, at time t, can be represented uniquely by the SHC, $A_n^m(k)$. Here, $$k = \frac{\omega}{c},$$

c is the speed of sound (~343 m/s), $\{r_r,\theta_r,\varphi_r\}$ is a point of reference (or observation point), $j_n(\cdot)$ is the spherical Bessel function of order n, and $Y_n^m$ $(\theta_n,\varphi_r)$ are the spherical harmonic basis functions of order n and suborder m. It can be recognized that the term in square brackets is a frequency-domain representation of the signal (i.e., $S(\omega,r_r,\theta_r,\varphi_r)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions.

A number of spherical harmonic basis functions for a particular order may be determined as: # basis functions= (n+1)^2. For example, a tenth order (n=10) would correspond to 122 spherical harmonic basis functions (e.g., (10+1)^2). The SHC $A_n^m(k)$ can either be physically acquired (e.g., recorded) by various microphone array configurations or, alternatively, they can be derived from channel-based or object-based descriptions of the sound field. The SHC represent scene-based audio, where the SHC may be input to an audio encoder to obtain encoded SHC that may promote more efficient transmission or storage. For example, a fourth-order representation involving $(1+4)^2$ (25, and hence fourth order) coefficients may be used.

To illustrate how the SHCs may be derived from an object-based description, consider the following equation. The coefficients $A_n^m(k)$ for the soundfield corresponding to an individual audio object may be expressed as:

$$A_n^m(k)=g(\omega)(-4\pi ik)h_n^{(2)}(kr_s)Y_n^{m*}(\theta_s,\varphi_s),$$

where i is $\sqrt{-1}$, $h_n^{(2)}(\cdot)$ is the spherical Hankel function (of the second kind) of order n, and $\{r_s,\theta_s,\varphi_s\}$ is the location of the object. Knowing the object source energy $g(\omega)$ as a function of frequency (e.g., using time-frequency analysis techniques, such as performing a fast Fourier transform on the PCM stream) enables conversion of each PCM object and the corresponding location into the SHC $A_n^m(k)$. Further, it can be shown (since the above is a linear and orthogonal decomposition) that the $A_n^m(k)$ coefficients for each object are additive. In this manner, a multitude of PCM objects can be represented by the $A_n^m(k)$ coefficients (e.g., as a sum of the coefficient vectors for the individual objects). Essentially, the coefficients contain information about the sound field (the pressure as a function of 3D coordinates), and the above represents the transformation from individual objects to a representation of the overall sound field, in the vicinity of the observation point $\{r_r,\theta_r,\varphi_r\}$. The remaining figures are described below in the context of object-based and SHC-based audio coding.

Referring to FIG. 1, a system 100 that is operable to dynamically change a microphone element configuration based on different criteria is shown. The system 100 includes a microphone array 102 coupled to a processor 110. The system 100 may be included in a mobile device (e.g., a mobile phone), a robot, a virtual reality device, a headset, an optical wearable device, etc.

The microphone array 102 includes a microphone cluster 104, a microphone cluster 106, and a microphone cluster 108. Although three microphone clusters 104, 106, 108 are shown, in other implementations, the microphone array 102 may include additional (or fewer) microphone clusters. As a non-limiting example, the microphone array 102 may include twelve microphone clusters. Each microphone cluster 104, 106, 108 includes a plurality of microphone elements (e.g., two or more microphones). The microphone array 102 may have different geometries (e.g., shapes). For example, the microphone array 102 may be a spherical microphone array (e.g., have a spherical geometry), a linear microphone array (e.g., have a linear geometry), a circular microphone array (e.g., have a circular geometry), etc.

As depicted in FIG. 1, the microphone clusters 104, 106 include four microphone elements. For example, the microphone cluster 104 includes a microphone element (Mic) 172, a microphone element 174, a microphone element 176, and a microphone element 178. Although the microphone cluster 104 is shown to include fourth microphone elements 172-178, in other implementations, the microphone cluster 104 may include additional (or fewer) microphone elements. According to one implementation, two microphone elements of the microphone elements 172-178 may be included in a microelectromechanical system (MEMS) package, a package made of metal, a package made of ceramic, a package made of fiber glass, a package made of a silicon material, a package made from a printed circuit board material, a package made of another material, etc. As a non-limiting example, a first MEMS package may include the microphone elements 172, 174, and a second MEMS package may include the microphone elements 176, 178. The microphone element 172 includes an analog-to-digital converter (ADC) 152, the microphone element 174 includes an ADC 154, the microphone element 186 includes an ADC 156, and the microphone element 178 includes an ADC 158. Although the ADCs 152, 154, 156, 158 are shown to be included in the microphone elements 172-178, respectively, it should be understood that the ADCs 152, 154, 156, 158 may also be coupled to the microphone elements 172-178.

Additionally, as depicted in FIG. 1, the microphone cluster 106 includes a microphone element 182, a microphone element 184, a microphone element 186, and a microphone element 188. According to one implementation, two microphone elements of the microphone elements 182-188 may be included in a MEMS package, a package made of metal, a package made of ceramic, a package made of fiber glass, a package made of a silicon material, a package made from a printed circuit board material, a package made of another material, etc. As a non-limiting example, a third MEMS package may include the microphone elements 182, 184, and a fourth MEMS package may include the microphone elements 186, 188. The microphone element 182 includes an ADC 162, the microphone element 184 includes an ADC 164, the microphone element 186 includes an ADC 166, and the microphone element 188 includes an ADC 188. Although the ADCs 162, 164, 166, 168 are shown to be included in the microphone elements 182-188, respectively, it should be understood that the ADCs 162, 164, 166, 168 may also be coupled to the microphone elements 182-188.

Each microphone cluster 104, 106 includes a single acoustic port opening. For example, the microphone cluster 104 includes an acoustic port opening 150 that is coupled to each microphone element 172-178 via corresponding acoustic ports, and the microphone cluster 106 includes an acoustic port opening 160 that is coupled to each microphone element 182-188 via corresponding acoustic ports. Thus, a "microphone cluster" may include a physical arrangement of microphone elements that are coupled to the same acoustic port opening. An example implementation of the microphone cluster 104 is shown in FIG. 2A.

Figure 2A:
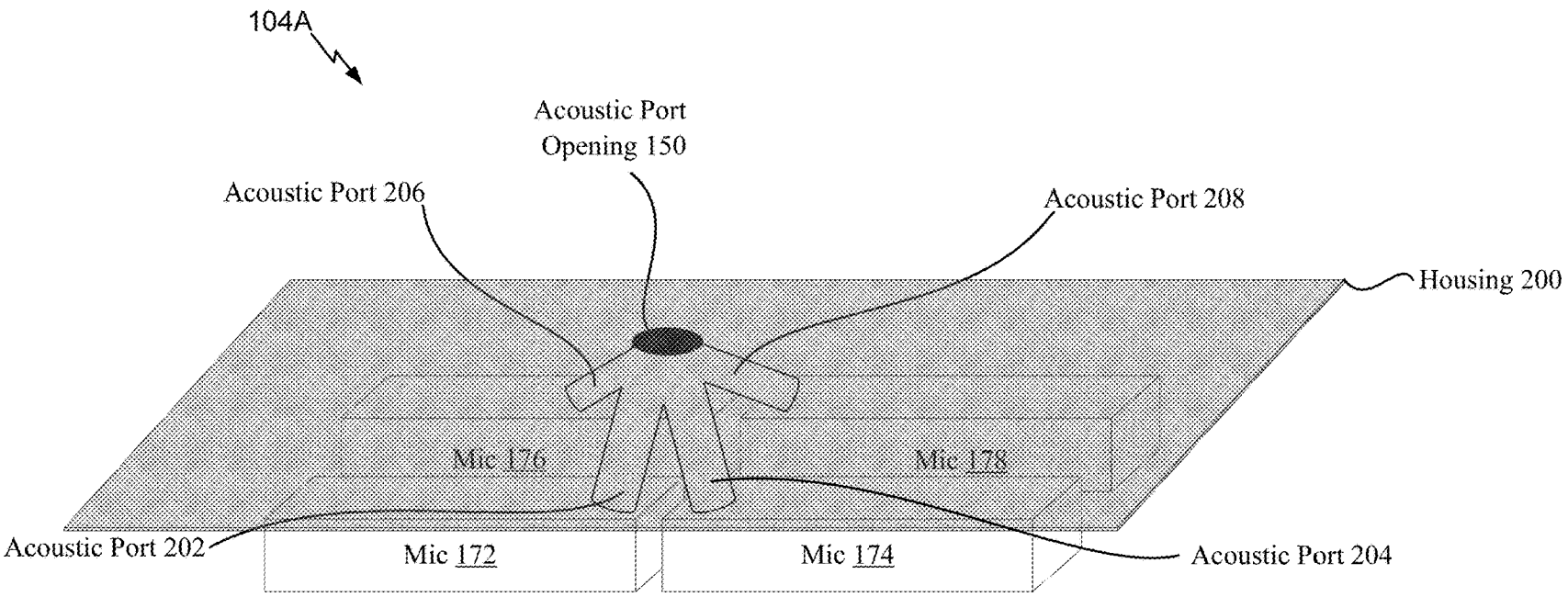
FIG. 2A is an illustrative example of a microphone cluster that includes multiple microphone elements coupled to a single acoustic port opening.
Figure 2B:
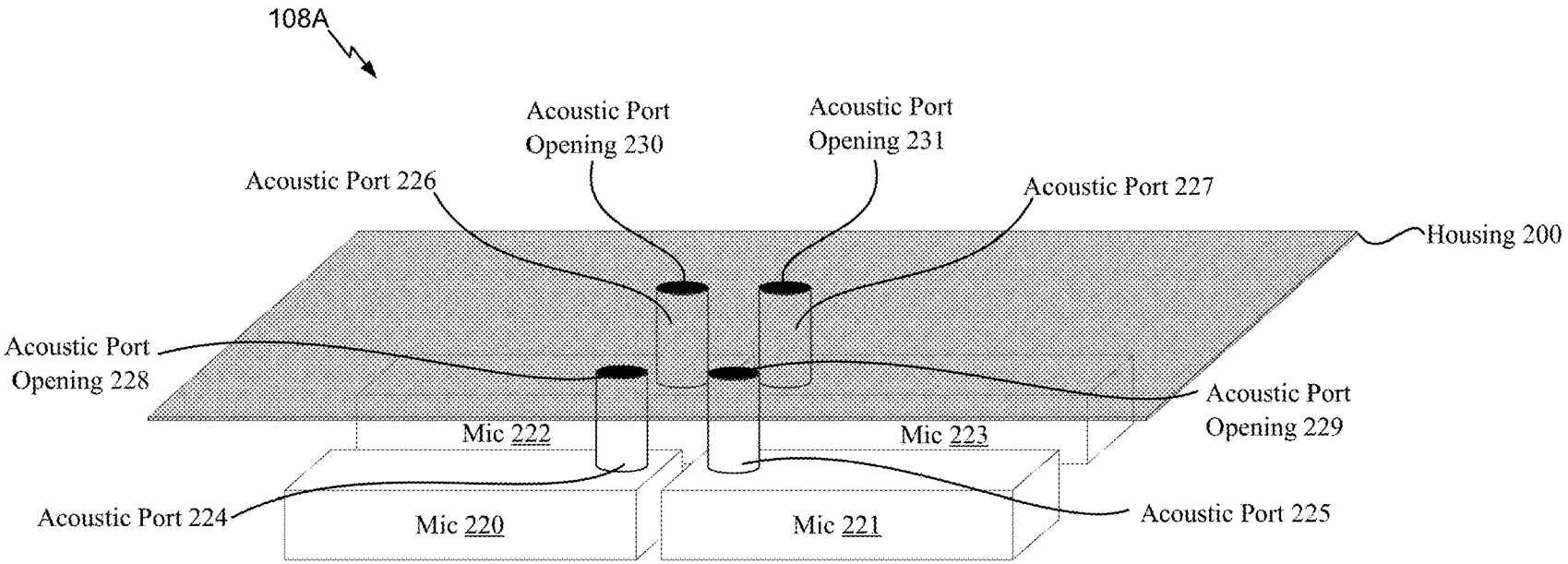
FIG. 2B is an illustrative example of a microphone cluster that includes multiple acoustic port openings.

Referring to FIG. 2A, a microphone cluster 104A is shown. According to one implementation, the microphone cluster 104A is an illustrative example of the microphone cluster 104 of FIG. 1. A housing 200 is positioned over the microphone elements 172-178. Two or more of the microphone elements 172-178 may be included in a MEMS package, a package made of metal, a package made of ceramic, a package made of fiber glass, a package made of a silicon material, a package made from a printed circuit board material, a package made of another material, etc. An acoustic port 202 is coupled to the microphone element 172, an acoustic port 204 is coupled to the microphone element 174, an acoustic port 206 is coupled to the microphone element 176, and an acoustic port 208 is coupled to the microphone element 178. The housing 200 includes the acoustic port opening 150 that is coupled to the acoustic ports 202-208. Thus, all four acoustic ports 202-208 are coupled to the single acoustic port opening 150 of the microphone cluster 104A. Each acoustic port 202-208 may have a similar length. According to one implementation, the length of each acoustic port 202-208 is between five millimeters and ten millimeters.

Referring back to FIG. 1, the microphone array 102 may be configured to capture one or more audio objects associated with a three-dimensional sound field. For example, a sound source 140 may generate audio 142 that is captured by the microphone array 102. Because each microphone cluster 104, 106, 108 is positioned at a different location of the microphone array 102, each microphone cluster 104, 106, 108 may receive (e.g., capture) different audio signals via the corresponding acoustic port openings. For example, the microphone cluster 104 may receive an audio signal 151 (associated with the audio 142) via the acoustic port opening 150, and the microphone cluster 106 may receive an audio signal 161 (associated with the audio 142) via the acoustic port opening 160.

After the audio signals 151, 161 are received using the corresponding acoustic port openings 150, 160, each respective microphone element 172-178, 182-188 may capture soundwaves associated with the audio signals 151, 161. To illustrate, the audio signal 151 may be comprised of multiple soundwaves having substantially similar properties (e.g., phases and amplitudes). With reference to FIGS. 2-3, as the audio signal 151 is received by the acoustic port opening 150, first soundwaves 302 of the audio signal 151 may travel through the acoustic port 202 towards the microphone element 172, second soundwaves 304 of the audio signal 151 may travel through the acoustic port 204 towards the microphone element 174, third soundwaves 306 of the audio signal 151 may travel through the acoustic port 206 towards the microphone element 176, and fourth soundwaves 308 of the audio signal 151 may travel through the acoustic port 208 towards the microphone element 178.

Thus, the microphone element 172 captures audio 312 based on the first soundwaves 302 of the audio signal 151, the microphone element 174 captures audio 314 based on the second soundwaves 304 of the audio signal 151, the microphone element 176 captures audio 316 based on the third soundwaves 306 of the audio signal 151, and the microphone element 178 captures audio 318 based on the fourth soundwaves 308 of the audio signal 151. The microphone elements 172-178 may be configured to capture the audio 312-318 at the same time because the lengths of the acoustic ports 202-208 are similar. As a result, the microphone cluster 104A may operate as a "natural amplifier" and amplify the audio signal 151 in response to each microphone element 172-178 capturing the audio 312-318 at the same time. For example, because a typical microphone configuration has a one-to-one ratio of microphone elements and acoustic port openings (e.g., each microphone element has a separate acoustic port opening), a single microphone element in a typical configuration would capture the audio signal 151. However, in FIGS. 2-3, four microphone elements 172-178 capture the audio signal 151, which may improve a gain of the audio signal 151 by up to twelve decibels compared to a cluster having a single microphone element for each acoustic port.

The ADC 152 converts the captured audio 312 from an analog signal into a digital signal 153, the ADC 154 converts the captured audio 314 from an analog signal into a digital signal 155, the ADC 156 converts the captured audio 316 from an analog signal into a digital signal 157, and the ADC 158 converts the captured audio 318 from an analog signal into a digital signal 159. The digital signals 153, 155, 157, 159 are provided to the processor 110.

Figure 3:
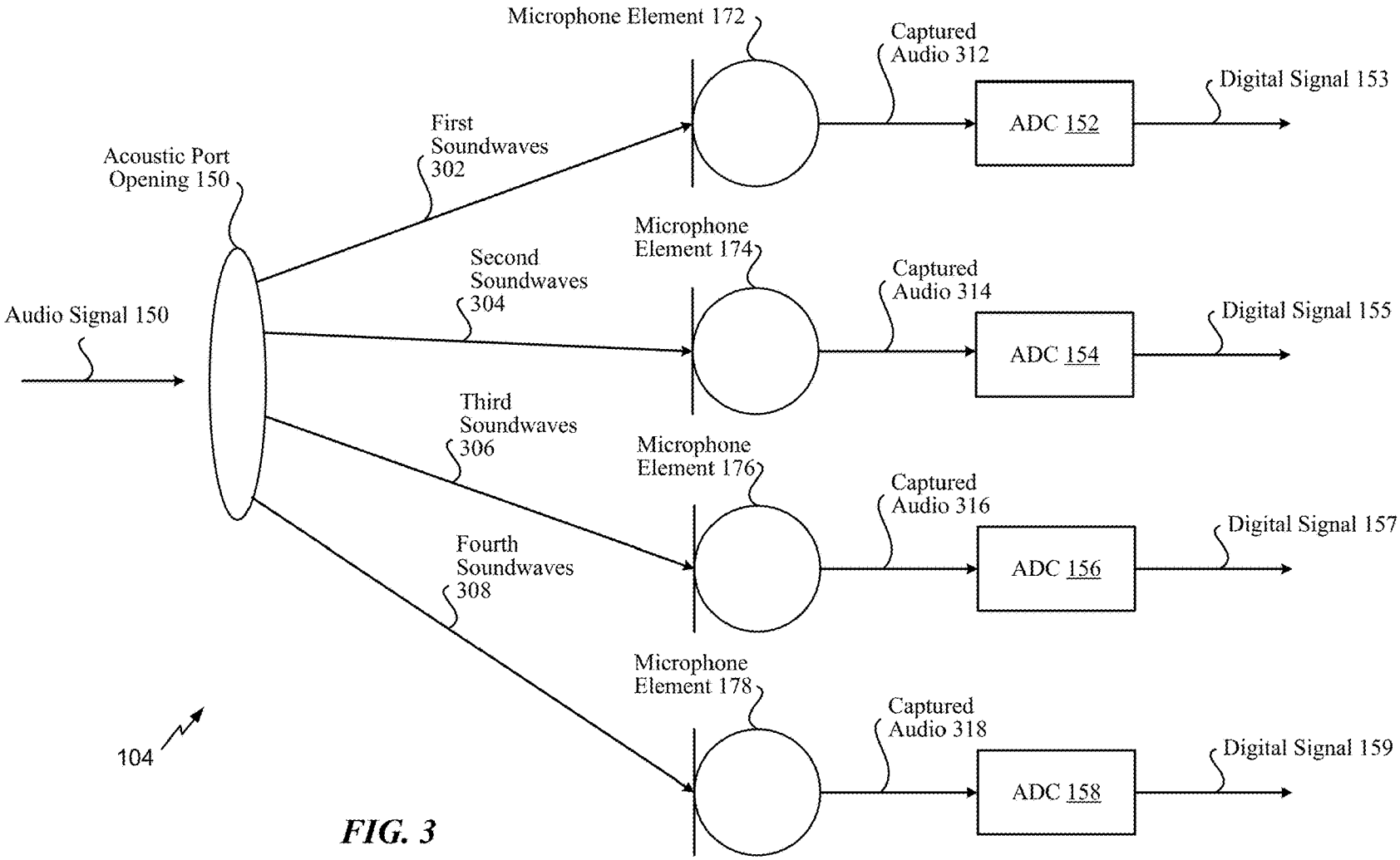
FIG. 3 is another illustrative example of the microphone cluster that includes multiple microphone elements coupled to a single acoustic port opening.
Figure 4:
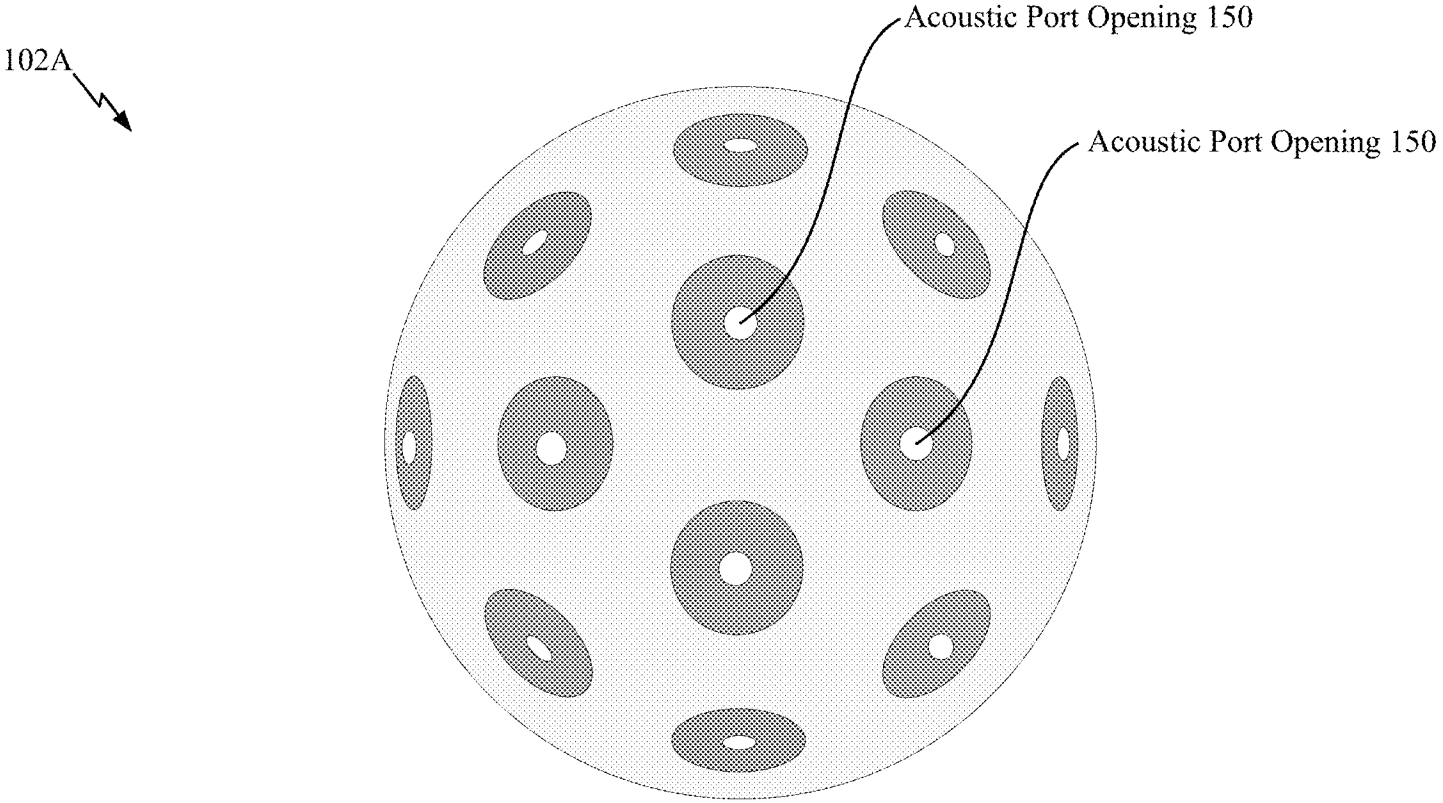
FIG. 4 is an illustrative example of a microphone array.

Referring to FIG. 4, a surrounding view of a microphone array 102A is shown. According to one implementation, the microphone array 102A may correspond to the microphone array 102 of FIG. 1. The microphone array 102A is a spherical array that includes a plurality of acoustic port openings. The spherical arrangement enables the microphone array 102A to capture sound from different directions. Although the microphone array 102A is depicted as a spherical array, in other implementations, the microphone array 102 may have other geometries (e.g., rectangular). As depicted in FIG. 4, the microphone array 102A includes the acoustic port opening 150 and the acoustic port opening 160. The acoustic port opening 150 is coupled to the microphone elements 172-178 as described with respect to FIGS. 2-3. In a similar manner, the acoustic port opening 160 is coupled to the microphone elements 182-188.

Referring back to FIG. 1, the microphone cluster 106 may have a similar configuration as the microphone cluster 104A of FIG. 2A. Additionally, the microphone cluster 106 may operate in a substantially similar manner as the microphone cluster 104. For example, the microphone element 182 captures first soundwaves of the audio signal 161, the microphone element 184 captures second soundwaves of the audio signal 161, the microphone element 186 captures third soundwaves of the audio signal 161, and the microphone element 188 captures fourth soundwaves of the audio signal 161. The ADC converts the captured audio based on the first soundwaves of the audio signal 161 from an analog signal into a digital signal 163, the ADC 164 converts captured audio based on the second soundwaves of the audio signal 161 from an analog signal into a digital signal 165, the ADC 166 converts captured audio based on the third soundwaves of the audio signal 161 from an analog signal into a digital signal 167, and the ADC 168 converts captured audio based on the fourth soundwaves of the audio signal 161 from an analog signal into a digital signal 169. The digital signals 163, 165, 167, 169 are provided to the processor 110.

Although each microphone cluster 104, 106 is shown to have a single acoustic port opening, in other implementations, one or more microphone clusters in the microphone array 102 may have different configurations. For example, referring to FIG. 2B, a microphone cluster 108A having multiple acoustic port openings is shown. According to one implementation, the microphone cluster 108A is included in the microphone array 102. As a non-limiting example, the microphone cluster 108A may correspond to the microphone cluster 108 of FIG. 1.

The microphone cluster 108A includes a microphone element 220, a microphone element 221, a microphone element 222, and a microphone element 223. Two or more of the microphone elements 220-223 may be included in a MEMS package, a package made of metal, a package made of ceramic, a package made of fiber glass, a package made of a silicon material, a package made from a printed circuit board material, a package made of another material, etc. The housing 200 is positioned over the microphone elements 220-223. An acoustic port 224 is coupled to the microphone element 220, an acoustic port 225 is coupled to the microphone element 221, an acoustic port 226 is coupled to the microphone element 222, and an acoustic port 227 is coupled to the microphone element 223. The housing 200 includes an acoustic port opening 228 associated with the acoustic port 224, an acoustic port opening 229 associated with the acoustic port 225, an acoustic port opening 230 associated with the acoustic port 226, and an acoustic port opening 231 associated with the acoustic port 227. According to FIG. 2B, the microphone elements 220-223 are arranged such that the acoustic ports 224-227 are proximate to one another at the center of the microphone cluster 108A.

Figure 2C:
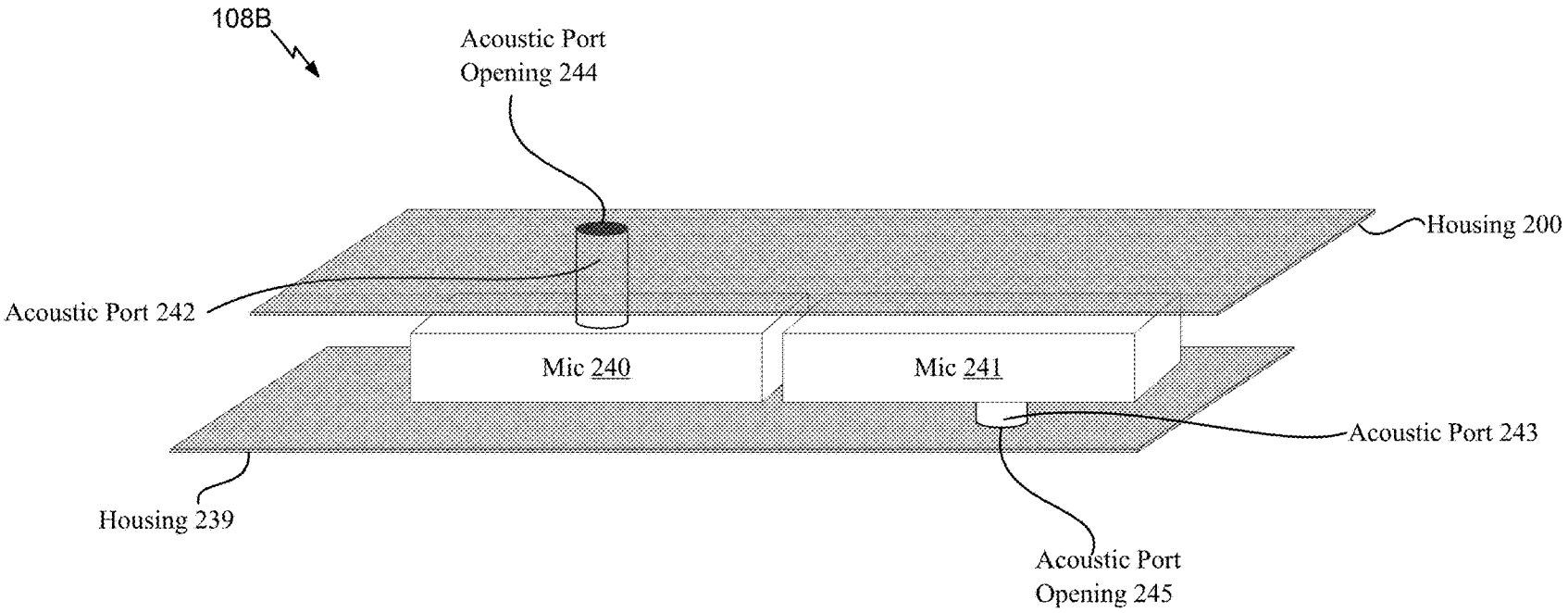
FIG. 2C is an illustrative example of a microphone cluster that includes multiple acoustic port openings.

Referring to FIG. 2C, another non-limiting example of the microphone cluster 108 is shown and is designated 108B. The microphone cluster 108B includes a microphone element 240 and a microphone element 241. The housing 200 is positioned over the microphone elements 240, 241, and a housing 239 is positioned beneath (e.g., below) the microphone elements 240, 241.

An acoustic port 242 is coupled to the microphone element 240, and an acoustic port 243 is coupled to the microphone element 241. The housing 200 includes an acoustic port opening 244 associated with the acoustic port 242, and the housing 239 includes an acoustic port opening 245 associated with the acoustic port 243. Thus, the microphone array 108B includes two non-coplanar acoustic port openings 244, 245.

Figure 2D:
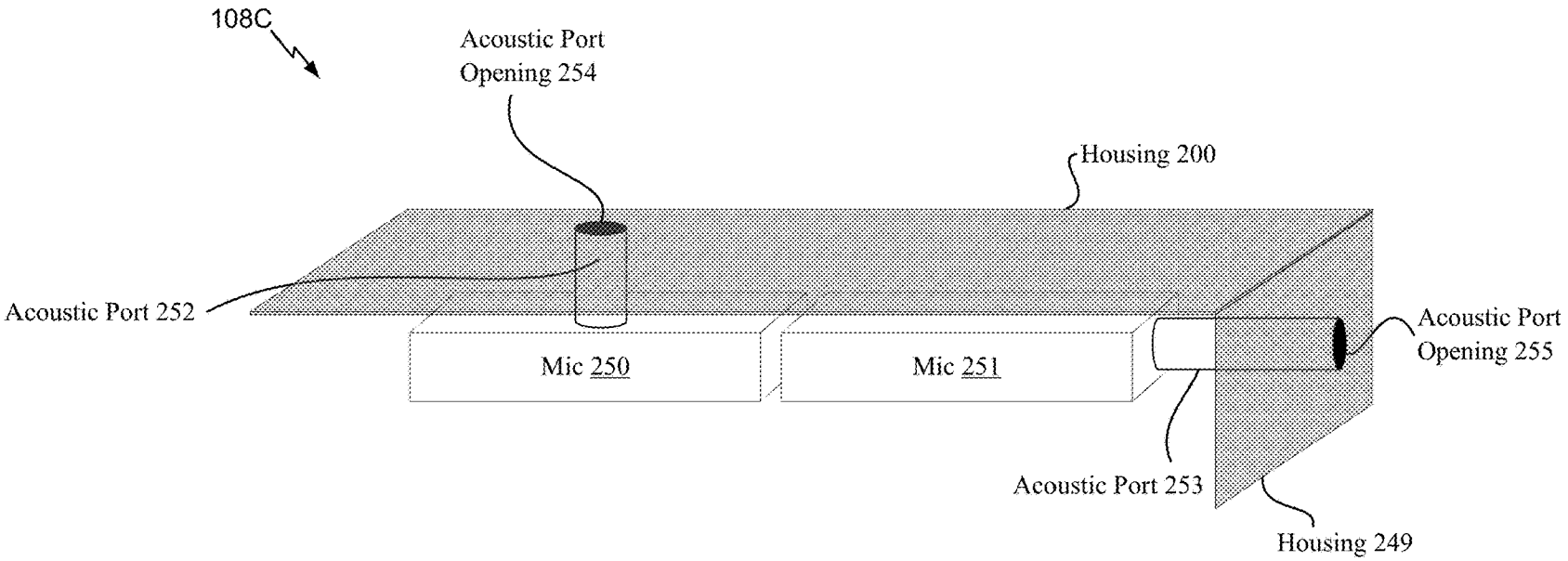
FIG. 2D is another illustrative example of a microphone cluster that includes multiple acoustic port openings.

Referring to FIG. 2D, another non-limiting example of the microphone cluster 108 is shown and is designated 108C. The microphone cluster 108C includes a microphone element 250 and a microphone element 251. The housing 200 is positioned over the microphone elements 250, 251, and a housing 249 is positioned to the side (e.g., the right side) of the microphone elements 250, 251.

An acoustic port 252 is coupled to the microphone element 250, and an acoustic port 253 is coupled to the microphone element 251. The housing 200 includes an acoustic port opening 254 associated with the acoustic port 252, and the housing 249 includes an acoustic port opening 255 associated with the acoustic port 253. The microphone array 108C includes two orthogonal acoustic port openings 254, 255.

Although the microphone elements shown in FIGS. 2C-2D are rectangular, in other implementations, the microphone elements may have different geometries. As non-limiting examples, the microphone elements may be circular in geometry, square-shaped in geometry, triangular in geometry, or another shape in geometry.

Figure 2E:
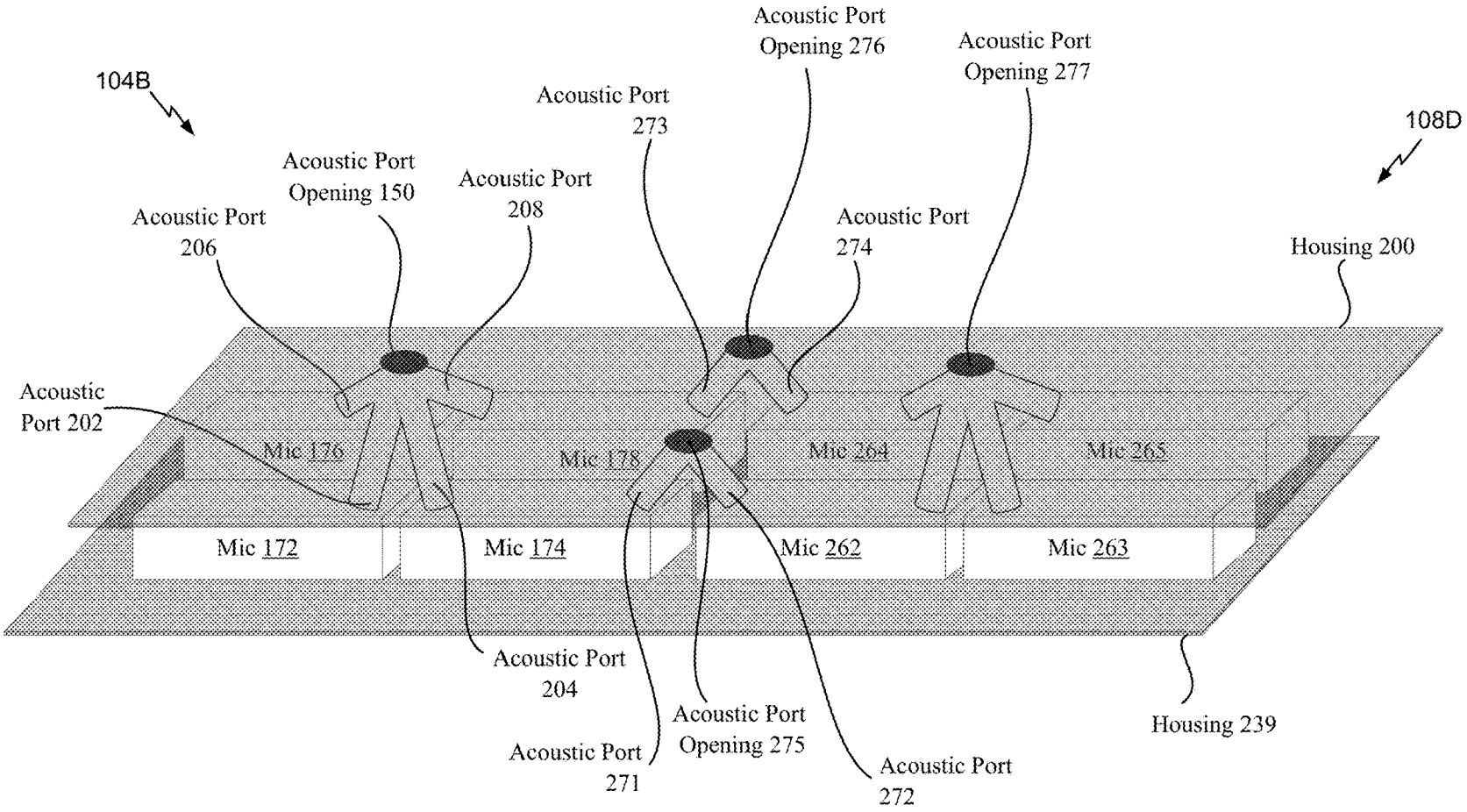
FIG. 2E is an illustrative example of two microphone clusters that include shared acoustic port openings.

Referring to FIG. 2E, an example of two microphone clusters 104B, 108D that share acoustic port openings is shown. According to one implementation, the microphone cluster 104B may correspond to the microphone cluster 104 of FIG. 1 or the cluster 104A of FIG. 2A. For example, the microphone cluster 104B has a substantially similar configuration as the microphone cluster 104A. The microphone cluster 108D may correspond to the microphone cluster 108 of FIG. 1. The microphone cluster 108D a microphone element 262, a microphone element 263, a microphone element 264, and a microphone element 265.

The housing 200 is positioned over the microphone elements 172-178, 262-265. The housing 239 is positioned below (e.g., beneath) the microphone elements 172-178, 262-265. The acoustic port 202 is coupled to the microphone element 172, the acoustic port 204 is coupled to the microphone element 174, the acoustic port 206 is coupled to the microphone element 176, and the acoustic port 208 is coupled to the microphone element 178. The housing 200 includes the acoustic port opening 150 that is coupled to the acoustic ports 202-208. Thus, all four acoustic ports 202-208 are coupled to the single acoustic port opening 150 of the microphone cluster 104A.

Additionally, the microphone clusters 104B, 108D are coupled to another acoustic port opening 275 (e.g., a shared acoustic port opening) in the housing 200, and the microphone clusters 104B, 108D are coupled to another acoustic port opening 276 (e.g., a shared acoustic port opening) in the housing 200. For example, an acoustic port 271 is coupled to the microphone element 174, an acoustic port 272 is coupled to the microphone element 262, and the acoustic port opening 275 in the housing is coupled to the acoustic ports 271, 272. Additionally, an acoustic port 273 is coupled to the microphone element 178, an acoustic port 274 is coupled to the microphone element 264, and the acoustic port opening 275 in the housing 200 is coupled to the acoustic ports 273, 274. Thus, the acoustic port openings 275, 276 are shared between two microphone clusters 104B, 108D.

Although the acoustic port openings 275, 276, 277 are located in the housing 200, in other implementations, one or more of the acoustic port openings 275, 276, 277 may be located in the housing 239. For example, one or more of the acoustic port openings 275, 276, 277 may be located beneath the microphone elements 172-178, 262-265 to capture sound from a substantially different location than the sound captured using the acoustic port opening 150.

Referring back to FIG. 1, the processor 110 includes a directionality determination unit 111, a cluster configuration unit selector 112, a sound source tracking unit 113, a signal-to-noise comparison unit 114, an ambisonics generation unit 115, and an audio encoder 116. The processor 110 may be configured to dynamically change a microphone element configuration for each cluster 104, 106, 108 based on different criteria. As a non-limiting example, the processor 110 may change which microphone clusters 104, 106, 108 are activated and which microphone clusters 104, 106, 108 are deactivated.

The directionality determination unit 111 may be configured to determine directionality information 120 associated with the sound source 140 based on the microphone array 102. For example, the directionality determination unit 111 may process the digital signals 153, 155, 157, 159, 163, 165, 167, 169 to determine which microphone cluster 104, 106 is more proximate to the sound source 140. According to one implementation, the directionality determination unit 111 may compare an amplitude of sound as encoded in the digital signals to determine which microphone cluster 104, 106 is more proximate to the sound source 140. To illustrate, if the sound encoded in the digital signals 163, 165, 167, 169 have a larger amplitude than the sound encoded in the digital signals 153, 155, 157, 159, the directionality information 120 may indicate that the sound source 140 is more proximate to the microphone cluster 106.

Based on a determination that the sound source 140 is positioned closer to the microphone cluster 106, the cluster configuration unit selector 112 may select a first microphone element configuration 121 for the microphone cluster 104 and may select a second microphone element configuration 122 for the microphone cluster 106. The cluster configuration unit selector 112 may send, via a control bus 130, a first signal (e.g., a deactivation signal) to transition the microphone cluster 104 into the first microphone element configuration 121. In response to receiving the first signal, each microphone element 172-178 of the microphone cluster 104 is deactivated. Energy consumption at the microphone array 102 is reduced in response to selection of the first microphone element configuration 121 for the microphone cluster 104. The cluster configuration unit selector 112 may send, via the control bus 130, a second signal (e.g., an activation signal) to the microphone cluster 106. In response to receiving the second signal, each microphone element 182-188 of the microphone cluster 106 is (or remains) activated.

In other implementations, the cluster configuration unit selector 112 may also select from microphone configurations that differ from the first and second microphone configurations 121, 122. For example, the cluster configuration unit selector 112 may select a third microphone element configuration (not shown) in which some (but not all) of the microphone elements of a cluster are deactivated. To illustrate, the microphone elements 172, 178 may be deactivated and the microphone elements 174, 76 may be activated if the third microphone element configuration is applied to the microphone cluster 104.

According to one implementation, the cluster configuration unit selector 112 may select the second microphone configuration 122 for six microphone clusters. To illustrate, the cluster configuration unit selector 112 may select the second microphone configuration 122 for a cluster facing a first cardinal direction (e.g., north), a cluster facing a second cardinal direction (e.g., south), a cluster facing a third cardinal direction (e.g., east), and a cluster facing a fourth cardinal direction (e.g., west). The cluster configuration unit selector 112 may also select the second microphone configuration 122 for a cluster facing an upwards direction and a cluster facing a downwards direction. After the six microphone clusters are operating according to the second microphone configuration 122, the directionality determination unit 111 determines the location of the sound source 140. Based on the location, the cluster configuration unit selector 112 activates additional microphone clusters pointing towards the sound source 140 (e.g., selects the second microphone configuration 122 for microphone clusters pointing towards the sound source 140). In some circumstances, the cluster configuration unit selector 112 deactivates the microphone elements 122 that are not facing the sound source 140 (e.g., selects the first microphone configuration 122 for the microphone clusters not facing the sound source 140).

The sound source tracking unit 113 may be configured to track movements of the sound source 140 as the sound source moves from a first position 123 to a second position 124. The sound source 140 is closer to the microphone cluster 104 when the sound source 140 is in the first position 123, and the sound source 140 is closer to the microphone cluster 106 when the sound source 140 is in the second position 123. Based on the tracked movements, the cluster configuration unit selector 112 may select the first microphone element configuration 121 for the microphone cluster 106 when the sound source 140 is proximate to the first position 123. Additionally, the cluster configuration unit selector 112 may select the second microphone element configuration 122 for the microphone cluster 104 when the sound source 140 is proximate to the first position 123. If the sound source 140 is proximate to the second position 124, the cluster configuration unit selector 112 may select the first microphone element configuration 121 for the microphone cluster 104 and may select the second microphone element configuration 122 for the microphone cluster 106.

The signal-to-noise comparison unit 114 may be configured to compare a first signal-to-noise ratio (SNR) 125 associated with the microphone cluster 104 to a second SNR 126 associated with the microphone cluster 106. The first SNR 125 is determined based on the digital signals 153, 155, 157, 159, and the second SNR 126 is determined based on the digital signals 163, 165, 167, 169. For example, the first SNR 125 may be indicative of an average SNR of the digital signals 153, 155, 157, 159, and the second SNR 126 may be indicative of an average SNR of the digital signals 163, 165, 167, 169. The cluster configuration unit selector 112 may select the first microphone element configuration 121 for the cluster 104 if the second SNR 126 is greater than the first SNR 125. A SNR for the microphone array 102 is increased in response to selection of the first microphone element configuration 121 for the cluster 104 because microphone elements 172-178 that capture a relatively large amount of noise are deactivated. Additionally, the cluster configuration unit selector 112 may select the second microphone element configuration 122 for the cluster 106 if the second SNR 126 is greater than the first SNR.

According to some implementations, the cluster configuration unit selector 112 may determine the microphone element configurations for each cluster 104, 106 based on the SNRs 125, 126 and the directionality information 120. As a non-limiting example, the cluster configuration unit selector 112 may select the first microphone element configuration 121 for microphone clusters having SNRs that fall below a threshold and for microphone clusters not facing the sound source 140. This may result in further power savings.

The ambisonics generation unit 115 may generate ambisonics signals 190 based on the digital signals provided by the microphone array 102. As a non-limiting example, based on the received digital signals, the ambisonics generation unit 115 may generate first-order ambisonics signals 190 (e.g., a W signal, an X signal, a Y signal, and a Z signal) that represent the three-dimensional sound field captured by the microphone array 102. According to other implementations, the ambisonics generation unit 115 may generate second-order ambisonics signals, third-order ambisonics signals, etc. The audio encoder 116 may be configured to encode the ambisonic signals 190 to generate an encoded bitstream 192. The encoded bitstream 192 may be transmitted to a decoder device to reconstruct the three-dimensional sound field that is represented by the ambisonic signals 190.

The techniques described with respect to FIGS. 1-4 may reduce power consumption at the microphone array 102 by selectively deactivating microphone clusters 104, 106, 108 based on different criteria. For example, processor 110 may determine a location of the sound source 140 relative to each microphone cluster 104, 106, 108 and deactivate the microphone clusters 104, 106, 108 that are not proximate to the sound source 140. Thus, the processor 110 may reduce the power level of the microphone clusters 104, 106, 108 that are positioned in such a manner to ineffectively capture the audio 142 output by the sound source 140. Deactivating select microphone clusters 104, 106, 108 may also decrease data throughput due to reduced data generation and audio signal processing at deactivated microphone clusters 104, 106, 108.

Additionally, the techniques described with respect to FIGS. 1-4 may balance data throughput with sound quality based on the techniques described with respect to FIG. 1. For example, in response to a determination that data throughput needs to be decreased, the processor 110 may deactivate the microphone clusters 104, 106, 108 having the lowest SNR to increase data throughput while maintaining a relatively high SNR for the microphone array 102.

Figure 5A:
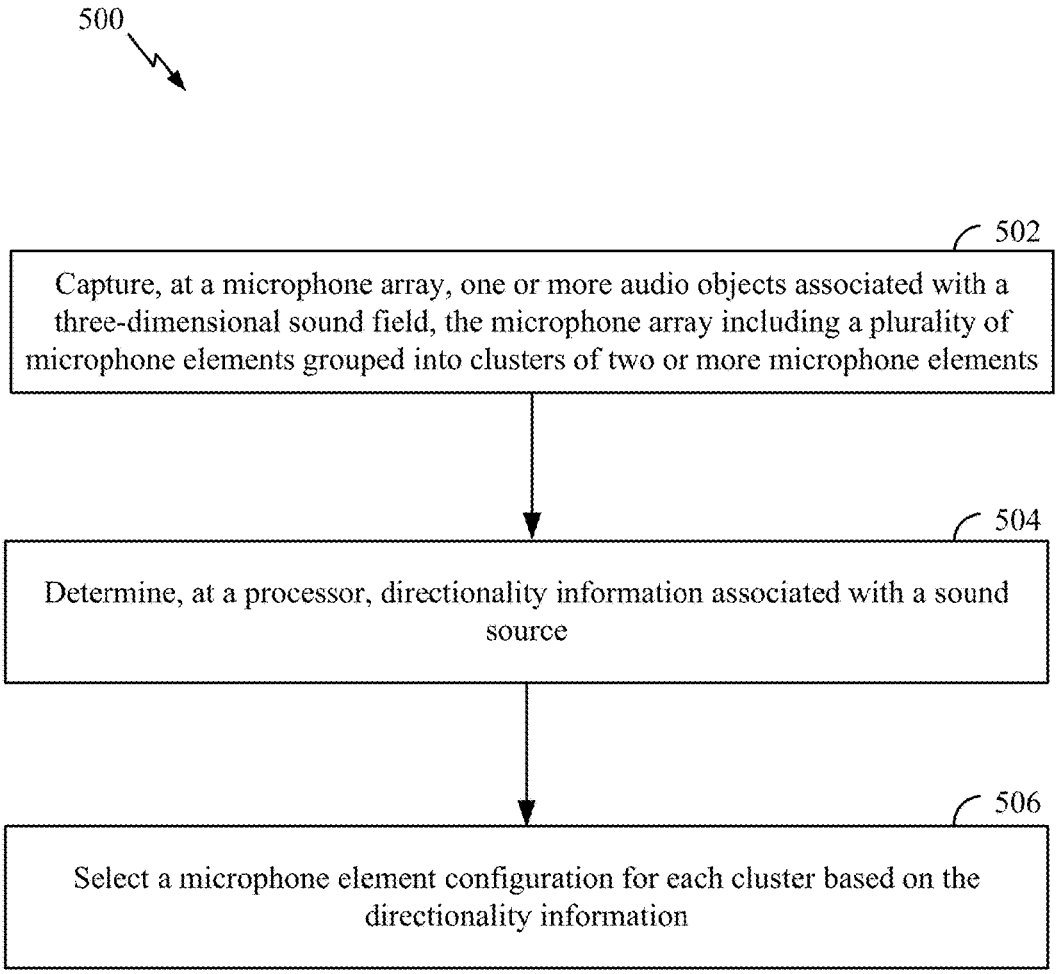
FIG. 5A is a method of dynamically changing a microphone element configuration based on different criteria.

Referring to FIG. 5A, a method 500 of dynamically changing a microphone element configuration based on different criteria is shown. The method 500 may be performed by the system 100 of FIG. 1, the microphone cluster 104A of FIG. 2A, the microphone cluster 108A of FIG. 2B, the microphone cluster 108B of FIG. 2C, the microphone cluster 108C of FIG. 2D, the microphone clusters 104B, 108D of FIG. 2E, the microphone cluster 104 of FIGS. 1 and 3, the microphone array 102 of FIG. 1, the microphone array 102A of FIG. 4, or a combination thereof.

The method 500 includes capturing, at a microphone array, one or more audio objects associated with a three-dimensional sound field, at 502. The microphone array includes a plurality of microphone elements grouped into clusters of two or more microphone elements. For example, referring to FIG. 1, the microphone array 102 captures the audio 142 from the sound source 140. The microphone array 102 includes the microphone elements 172-178, 182-188 grouped into the microphone clusters 104, 106.

The method 500 also includes determining, at a processor, directionality information associated with a sound source, at 504. For example, referring to FIG. 1, the directionality determination unit 111 may determine the directionality information 120 based on the received digital signals. The directionality information 120 indicates the location of the sound source 140 with respect to the microphone clusters 104, 106 of the microphone array 102.

The method 500 also includes selecting a microphone element configuration for each cluster based on the directionality information, at 506. For example, referring to FIG. 1, the cluster configuration unit selector 112 may select a microphone element configuration (e.g., the first microphone element configuration 121, the second microphone element configuration 122, or another microphone element configuration) for each microphone cluster 104, 106, 108 based on the directionality information 120.

The method 500 of FIG. 5A may reduce power consumption at the microphone array 102 by selectively deactivating microphone clusters 104, 106, 108 based on different criteria. For example, processor 110 may determine a location of the sound source 140 relative to each microphone cluster 104, 106, 108 and deactivate the microphone clusters 104, 106, 108 that are not proximate to the sound source 140. Thus, the processor 110 may reduce the power level of the microphone clusters 104, 106, 108 that are positioned in such a manner to ineffectively capture the audio 142 output by the sound source 140. Deactivating select microphone clusters 104, 106, 108 may also decrease data throughput due to reduced data generation and audio signal processing at deactivated microphone clusters 104, 106, 108.

Additionally, the method 500 may balance data throughput with sound quality based on the techniques described with respect to FIG. 1. For example, in response to a determination that data throughput needs to be decreased, the processor 110 may deactivate the microphone clusters 104, 106, 108 having the lowest SNR to increase data throughput while maintaining a relatively high SNR for the microphone array 102.

Figure 5B:
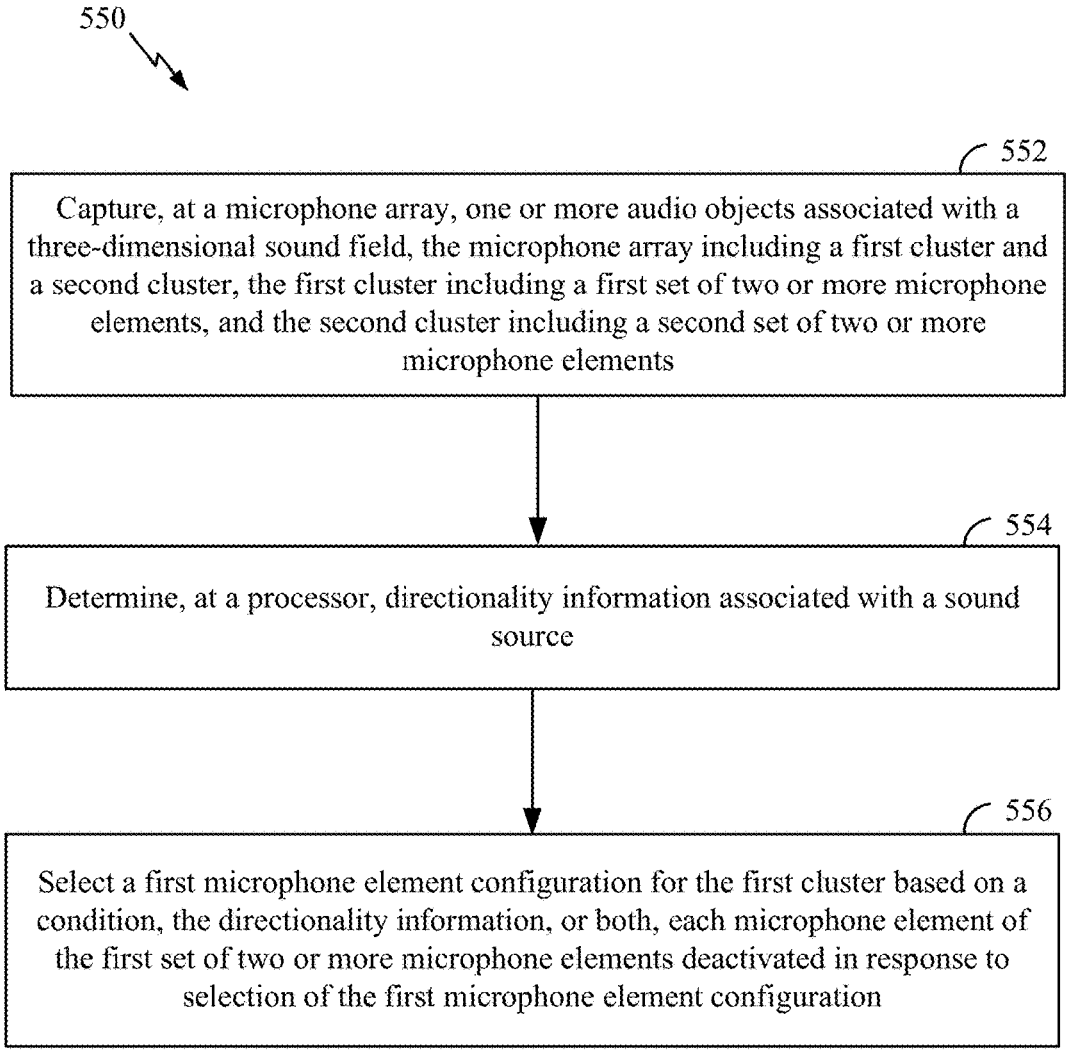
FIG. 5B is another method of dynamically changing a microphone element configuration based on different criteria.

Referring to FIG. 5B, another method 550 of dynamically changing a microphone element configuration based on different criteria is shown. The method 550 may be performed by the system 100 of FIG. 1, the microphone cluster 104A of FIG. 2A, the microphone cluster 108A of FIG. 2B, the microphone cluster 108B of FIG. 2C, the microphone cluster 108C of FIG. 2D, the microphone clusters 104B, 108D of FIG. 2E, the microphone cluster 104 of FIGS. 1 and 3, the microphone array 102 of FIG. 1, the microphone array 102A of FIG. 4, or a combination thereof.

The method 550 includes capturing, at a microphone array, one or more audio objects associated with a three-dimensional sound field, at 552. The microphone array includes a first cluster and a second cluster. The first cluster includes a first set of two or more microphone elements, and the second cluster includes a second set of two or more microphone elements. For example, referring to FIG. 1, the microphone array 102 captures the audio 142 from the sound source 140. The microphone array 102 includes the microphone elements 172-178, 182-188 grouped into the microphone clusters 104, 106.

The method 500 also includes determining, at a processor, directionality information associated with a sound source, at 554. For example, referring to FIG. 1, the directionality determination unit 111 may determine the directionality information 120 based on the received digital signals. The directionality information 120 indicates the location of the sound source 140 with respect to the microphone clusters 104, 106 of the microphone array 102.

The method 500 also includes selecting a first microphone element configuration for the first cluster based on a condition, the directionality information, or both, at 556. Each microphone element of the first set of two or more microphone elements is deactivated in response to selection of the first microphone element configuration. For example, referring to FIG. 1, the cluster configuration unit selector 112 may select the first microphone element configuration 121 for the microphone cluster 104 based on the directionality information 120, a condition, or both.

According to one implementation, the condition indicates that a signal-to-noise ratio associated with the cluster 104 fails to satisfy a signal-to-noise ratio threshold. According to another implementation, the condition indicates that data throughput associated with the microphone array 102 fails to satisfy a data throughput threshold. According to another implementation, the condition indicates that an amount of power consumed by the microphone array 102 exceeds a power limit.

In some implementations, the condition corresponds to reduction of the amount of power provided to the microphone array 102. In other implementations, the condition corresponds to a tradeoff between power consumption and a signal-to-noise ratio. For example, the condition may indicate that selection of the first microphone element configuration 121 for the microphone cluster 104 will result in an amount of power consumed by the microphone array 102 satisfying a power limit and a signal-to-noise ratio associated with the microphone array 102 satisfying a signal-to-noise ratio threshold.

According to some implementations, the method 550 includes after a fixed interval of time, selecting a second microphone element configuration for the first cluster. Each microphone element of the first set of two or more microphone elements is activated in response to selection of the second microphone element configuration. According to other implementations, the method 550 includes detecting that at least one signal associated with the second cluster fails to satisfy a signal threshold and selecting the second microphone element configuration for the first cluster in response to the detection.

Figure 8:
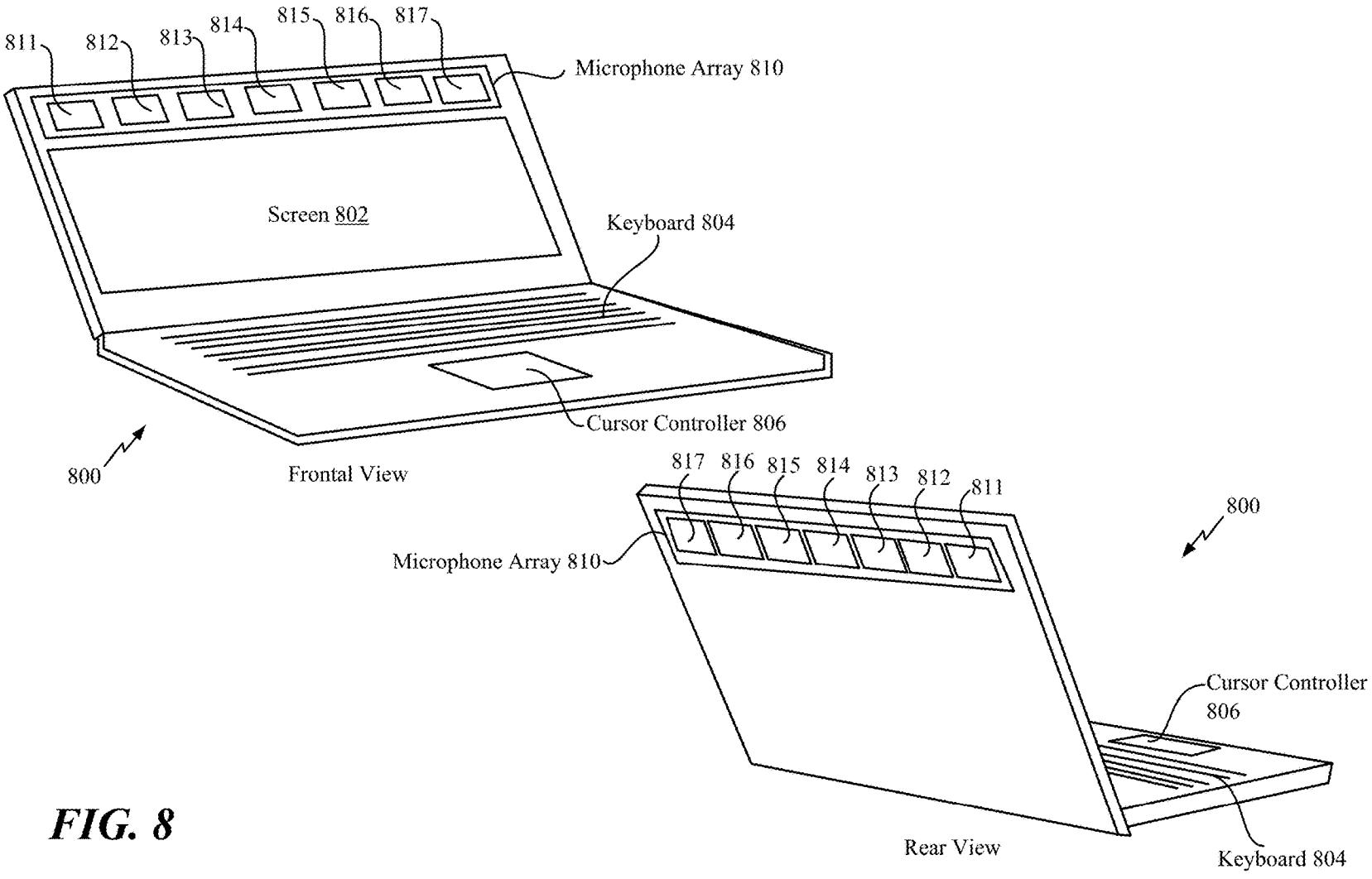
FIG. 8 is a diagram of a laptop that is operable to perform the techniques described with reference to FIGS. 1-6.

According to some implementations, the method 550 may include determining whether a laptop is open or closed, as further described with respect to FIG. 8. The microphone array 102 may be positioned across a top portion of the laptop, and the cluster 104 may be located near a top-center portion of the laptop, and the cluster 106 may be located near a top-side portion of the laptop. The method 550 may include selecting the first microphone element configuration 121 for the cluster 106 in response to a determination that the laptop is open. The method 550 may also include deactivating microphone elements coupled to acoustic port openings facing an inside portion of the laptop in response to a determination that the laptop is closed. For example, a microphone cluster of the laptop may have a configuration similar to the configuration of FIG. 2C. One or more microphone elements may be coupled to an acoustic port opening facing the inside portion of the laptop, and one or more microphone elements may be coupled to an acoustic port opening facing an outside portion of the laptop.

The method 550 of FIG. 5B may reduce power consumption at the microphone array 102 by selectively deactivating microphone clusters 104, 106, 108 based on different criteria. For example, processor 110 may determine a location of the sound source 140 relative to each microphone cluster 104, 106, 108 and deactivate the microphone clusters 104, 106, 108 that are not proximate to the sound source 140. Thus, the processor 110 may reduce the power level of the microphone clusters 104, 106, 108 that are positioned in such a manner to ineffectively capture the audio 142 output by the sound source 140. Deactivating select microphone clusters 104, 106, 108 may also decrease data throughput due to reduced data generation and audio signal processing at deactivated microphone clusters 104, 106, 108.

Additionally, the method 550 may balance data throughput with sound quality based on the techniques described with respect to FIG. 1. For example, in response to a determination that data throughput needs to be decreased, the processor 110 may deactivate the microphone clusters 104, 106, 108 having the lowest SNR to increase data throughput while maintaining a relatively high SNR for the microphone array 102.

Figure 6A:
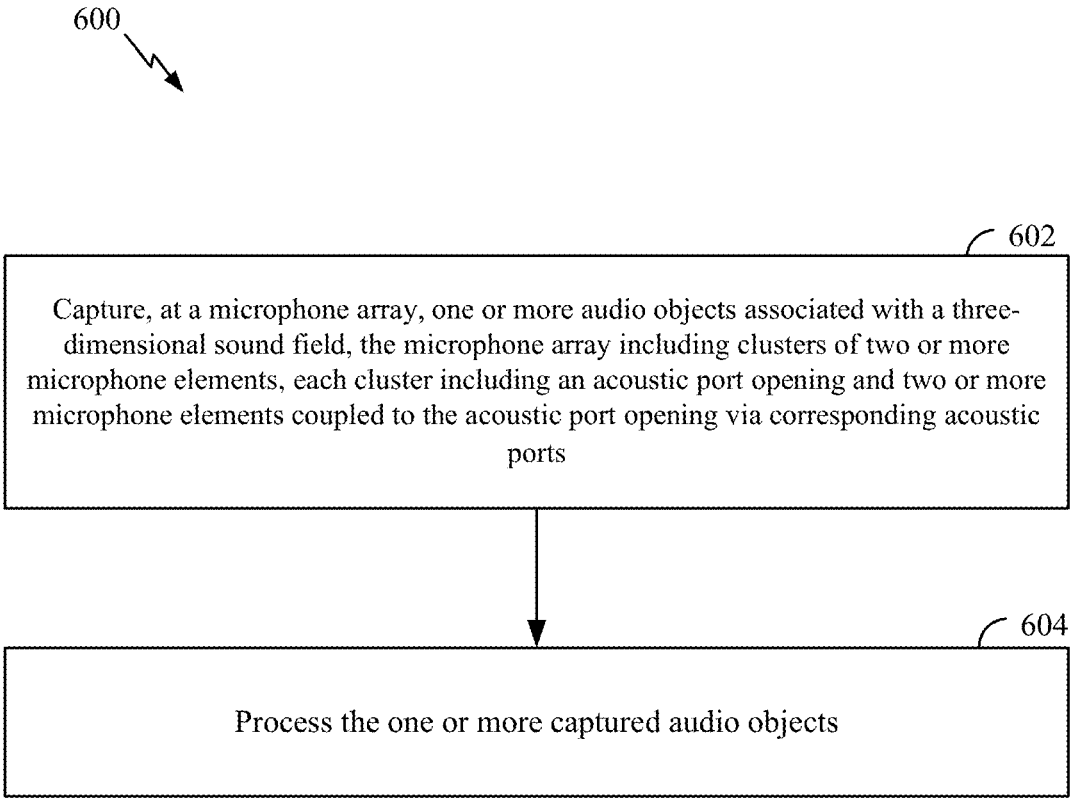
FIG. 6A is a method of capturing audio using a microphone array.

Referring to FIG. 6A, a method 600 of capturing audio using a microphone array is shown. The method 600 may be performed by the system 100 of FIG. 1, the microphone cluster 104A of FIG. 2A, the microphone cluster 108A of FIG. 2B, the microphone cluster 108B of FIG. 2C, the microphone cluster 108C of FIG. 2D, the microphone clusters 104B, 108D of FIG. 2E, the microphone cluster 104 of FIGS. 1 and 3, the microphone array 102 of FIG. 1, the microphone array 102A of FIG. 4, or a combination thereof.

The method 600 includes capturing, at a microphone array, one or more audio objects associated with a three-dimensional sound field, at 602. The microphone array includes clusters of two or more microphone elements. For the purposes of the method 600, each cluster includes an acoustic port opening and two or more microphone elements coupled to the acoustic port opening via corresponding acoustic port. Thus, for the purposes of the method 600, each cluster is defined by a single acoustic port opening. For example, referring to FIGS. 1-4, the microphone array 102 may capture the audio 142 from the sound source 140. The microphone array 102 includes the microphone clusters 104, 106, 108. The microphone cluster 104 includes the acoustic port opening 150 and four microphone elements 172-178 coupled to the acoustic port opening 150 via the corresponding acoustic ports 202-208.

The method 600 also includes processing the one or more captured audio objects, at 604. For example, the processor 110 may process the audio 142 captured by the microphone array 102.

The method 600 may enable the microphone cluster 104 to operate as a "natural amplifier" and amplify the audio signal 151 in response to each microphone element 172-178 capturing the audio 312-318 at the same time. For example, because a typical microphone configuration has a one-to-one ratio of microphone elements and acoustic port openings (e.g., each microphone element has a separate acoustic port opening), a single microphone element in a typical configuration would capture the audio signal 151. However, in FIGS. 2-3, four microphone elements 172-178 capture the audio signal 151, which may improve a gain of the audio signal 151 by up to twelve decibels compared to a cluster having a single microphone element for each acoustic port.

Figure 6B:
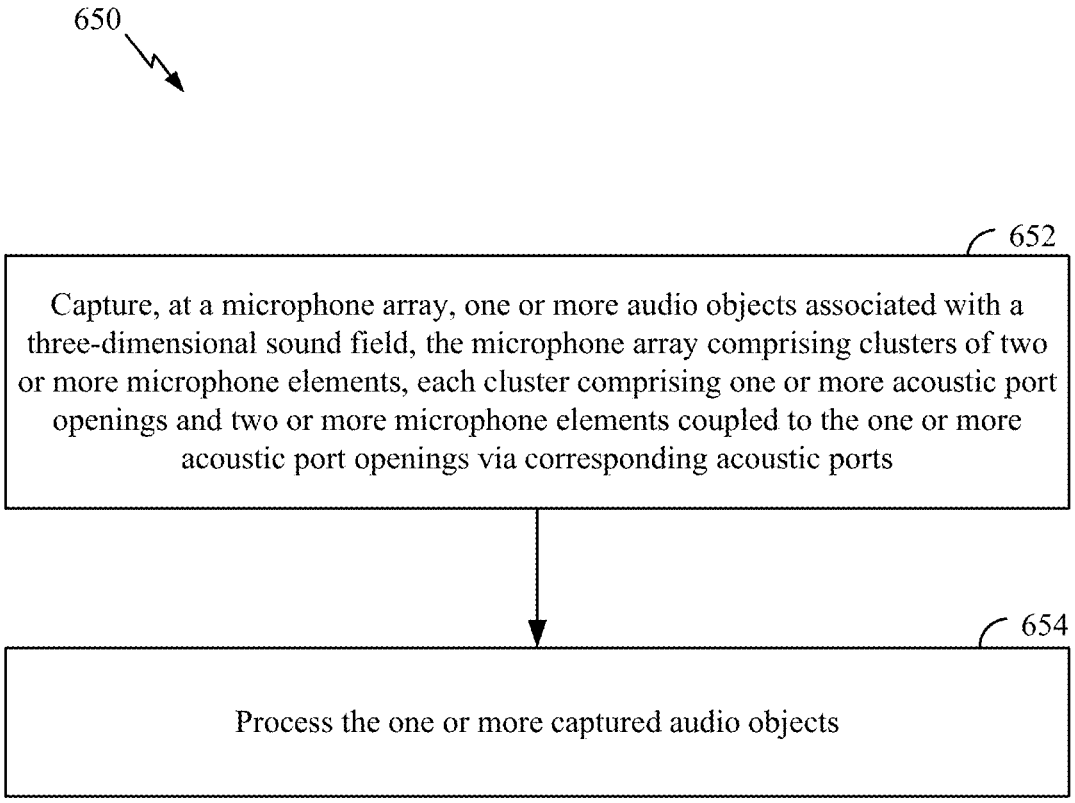
FIG. 6B is another method of capturing audio using a microphone array.

Referring to FIG. 6B, a method 650 of capturing audio using a microphone array is shown. The method 650 may be performed by the system 100 of FIG. 1, the microphone cluster 104A of FIG. 2A, the microphone cluster 108A of FIG. 2B, the microphone cluster 108B of FIG. 2C, the microphone cluster 108C of FIG. 2D, the microphone clusters 104B, 108D of FIG. 2E, the microphone cluster 104 of FIGS. 1 and 3, the microphone array 102 of FIG. 1, the microphone array 102A of FIG. 4, or a combination thereof.

The method 650 includes capturing, at a microphone array, one or more audio objects associated with a three-dimensional sound field, at 652. The microphone array includes clusters of two or more microphone elements. Each cluster includes one or more acoustic port openings and two or more microphone elements coupled to the one or more acoustic port openings via corresponding acoustic ports. For example, referring to FIGS. 1-4, the microphone array 102 may capture the audio 142 from the sound source 140. The microphone array 102 includes the microphone clusters 104, 106, 108. The microphone cluster 104 includes the acoustic port opening 150 and four microphone elements 172-178 coupled to the acoustic port opening 150 via the corresponding acoustic ports 202-208.

The method 650 also includes processing the one or more captured audio objects, at 654. For example, the processor 110 may process the audio 142 captured by the microphone array 102.

Figure 7:
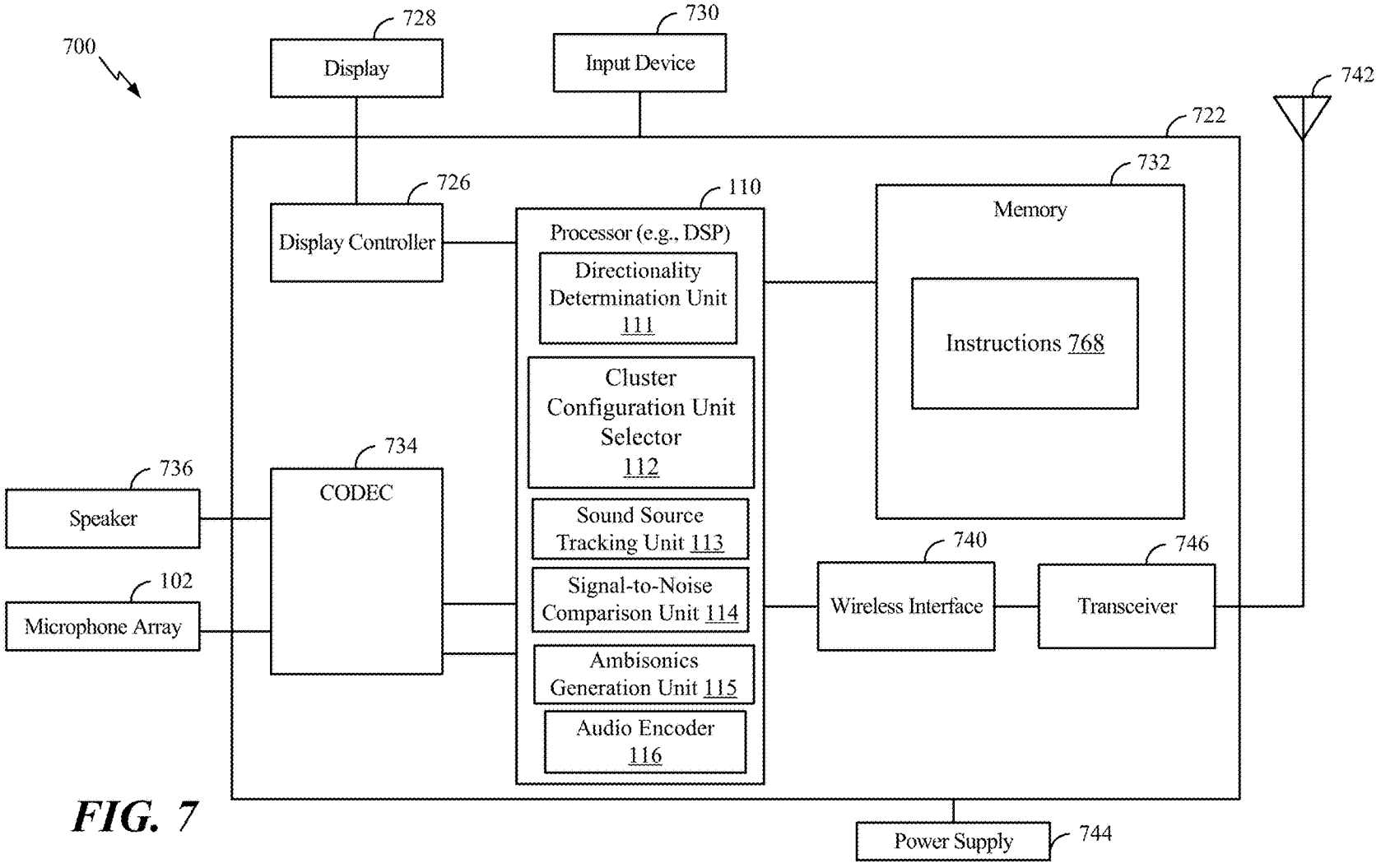
FIG. 7 is a block diagram of a particular illustrative example of a mobile device that is operable to perform the techniques described with reference to FIGS. 1-6.

Referring to FIG. 7, a block diagram of a particular illustrative implementation of a device (e.g., a wireless communication device) is depicted and generally designated 700. In various implementations, the device 700 may have more components or fewer components than illustrated in FIG. 7. In a particular implementation, the device 700 includes the processor 110, such as a central processing unit (CPU) or a digital signal processor (DSP), coupled to a memory 732. The processor 110 includes the directionality determination unit 111, the cluster configuration unit selector 112, the sound source tracking unit 113, the signal-to-noise comparison unit 114, the ambisonics generation unit 115, and the audio encoder 116.

The memory 732 includes instructions 768 (e.g., executable instructions) such as computer-readable instructions or processor-readable instructions. The instructions 768 may include one or more instructions that are executable by a computer, such as the processor 110.

FIG. 7 also illustrates a display controller 726 that is coupled to the processor 110 and to a display 728. A coder/decoder (CODEC) 734 may also be coupled to the processor 110. According to some implementations, at least one of the directionality determination unit 111, the cluster configuration unit selector 112, the sound source tracking unit 113, the signal-to-noise comparison unit 114, the ambisonics generation unit 115, or the audio encoder 116 is included in the CODEC 734. A speaker 736 and the microphone array 102 are coupled to the CODEC 734.

FIG. 7 further illustrates that a wireless interface 740, such as a wireless controller, and a transceiver 746 may be coupled to the processor 110 and to an antenna 742, such that wireless data received via the antenna 742, the transceiver 746, and the wireless interface 740 may be provided to the processor 110. In some implementations, the processor 110, the display controller 726, the memory 732, the CODEC 734, the wireless interface 740, and the transceiver 746 are included in a system-in-package or system-on-chip device 722. In some implementations, an input device 730 and a power supply 744 are coupled to the system-on-chip device 722. Moreover, in a particular implementation, as illustrated in FIG. 7, the display 728, the input device 730, the speaker 736, the microphone array 102, the antenna 742, and the power supply 744 are external to the system-on-chip device 722. In a particular implementation, each of the display 728, the input device 730, the speaker 736, the microphone array 102, the antenna 742, and the power supply 744 may be coupled to a component of the system-on-chip device 722, such as an interface or a controller.

The device 700 may include a headset, a mobile communication device, a smart phone, a cellular phone, a laptop computer, a computer, a tablet, a personal digital assistant, a display device, a television, a gaming console, a music player, a radio, a digital video player, a digital video disc (DVD) player, a tuner, a camera, a navigation device, a vehicle, a component of a vehicle, or any combination thereof, as illustrative, non-limiting examples.

In an illustrative implementation, the memory 732 may include or correspond to a non-transitory computer readable medium storing the instructions 768. The instructions 768 may include one or more instructions that are executable by a computer, such as the processor 110. The instructions 768 may cause the processor 110 to perform one or more operations described herein, including but not limited to one or more portions of the methods 500, 550, 600, 650 of FIGS. 5A-6B.

One or more components of the device 700 may be implemented via dedicated hardware (e.g., circuitry), by a processor executing instructions to perform one or more tasks, or a combination thereof. As an example, the memory 732 or one or more components of the processor 110, and/or the CODEC 734 may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 768) that, when executed by a computer (e.g., a processor in the CODEC 734 or the processor 110), may cause the computer to perform one or more operations described with reference to FIGS. 1-6B.

In a particular implementation, one or more components of the systems and devices disclosed herein may be integrated into a decoding system or apparatus (e.g., an electronic device, a CODEC, or a processor therein), into an encoding system or apparatus, or both. In other implementations, one or more components of the systems and devices disclosed herein may be integrated into a wireless telephone, a tablet computer, a desktop computer, a laptop computer, a set top box, a music player, a video player, an entertainment unit, a television, a game console, a navigation device, a communication device, a personal digital assistant (PDA), a fixed location data unit, a personal media player, or another type of device.

In conjunction with the described techniques, a first apparatus includes means for capturing one or more audio objects associated with a three-dimensional sound field. The means for capturing includes a first cluster and a second cluster. The first cluster includes a first set of two or more microphone elements, and the second cluster includes a second set of two or more microphone elements. For example, the means for capturing may include the microphone array 102 of FIGS. 1, 4, and 7, one or more other devices, circuits, modules, or any combination thereof.

The first apparatus also includes means for determining directionality information associated with a sound source. For example, the means for determining may include the processor 110 of FIGS. 1 and 7, the directionality determination unit 111 of FIGS. 1 and 7, the CODEC 734 of FIG. 7, instructions 768 stored in the memory 732 and executable by a processor (e.g., the processor 110) or the CODEC 734, one or more other devices, circuits, modules, or any combination thereof.

The first apparatus also includes means for selecting a first microphone element configuration for the first cluster based on a condition, the directionality information, or both. Each microphone element of the first set of two or more microphone elements is deactivated in response to selection of the first microphone element configuration. For example, the means for selecting may include the processor 110 of FIGS. 1 and 7, the cluster configuration unit selector 112 of FIGS. 1 and 7, the CODEC 734 of FIG. 7, instructions 768 stored in the memory 732 and executable by a processor (e.g., the processor 110) or the CODEC 734, one or more other devices, circuits, modules, or any combination thereof.

In conjunction with the described techniques, a second apparatus includes means for capturing one or more audio objects associated with a three-dimensional sound field. The means for capturing includes clusters of two or more microphone elements. Each cluster includes one or more acoustic port openings and two or more microphone elements coupled to the one or more acoustic port openings via corresponding acoustic ports. For example, the means for capturing may include the microphone array 102 of FIGS. 1, 4, and 7, one or more other devices, circuits, modules, or any combination thereof.

Referring to FIG. 8, a laptop 800 that is operable to dynamically change a microphone element configuration based on different criteria is shown. The laptop 800 includes a screen 802, a keyboard 804, and a cursor controller 806. In FIG. 8, a frontal view of the laptop 800 is shown and a rear view of the laptop 800 is shown.

A microphone array 810 is located along an upper portion of the laptop 800. As illustrated in FIG. 8, the microphone array 810 is located above the screen 802. However, in other implementations, the microphone array 810 may be positioned at other locations of the laptop 800. As non-limiting examples, the microphone array 810 may be positioned along a bottom portion (e.g., by the cursor controller 806) of the laptop 800 or may be positioned along a side portion of the laptop 800.

The microphone array 810 includes a microphone cluster 811, a microphone cluster 812, a microphone cluster 813, a microphone cluster 814, a microphone cluster 815, a microphone cluster 816, and a microphone cluster 817. According to one implementation, the microphone array 810 may operate in a substantially similar manner as the microphone array 102 of FIG. 1, and the microphone clusters 811-817 may have the same configuration (and operate in a substantially similar manner) as the microphone clusters 104, 106, 108 of FIG. 1, the microphone clusters of FIGS. 2A-2E, or a combination thereof. For example, a microphone element configuration of each microphone cluster 811-817 may be dynamically changed based on different criteria.

According to one implementation, in response to a determination that the laptop 800 is closed, the microphone clusters 811-817 may transition into the first microphone element configuration 121 to conserve energy. For example, microphone elements (not shown) within the microphone clusters 811-817 may transition into a low-power state (e.g., an "off" state) in response to a determination that the laptop 800 is closed. According to some implementations, one or more of the microphone clusters 811-817 may have a similar configuration as the microphone cluster 108B of FIG. 2C. For example, one or more of the microphone clusters 811-817 may have dual acoustic port openings (e.g., a first acoustic port opening facing the "screen" side of the laptop 800 and a second acoustic port opening facing "rear" side of the laptop 800). In such a scenario, microphone elements coupled to the first acoustic port opening may be deactivated in response to a determination that the laptop 800 is closed, and microphone elements coupled to the second acoustic port opening may be activated in response to a determination that the laptop 800 is closed.

According to another implementation, in response to a determination that the laptop 800 is open, select microphone clusters 811, 812, 816, 817 may transition into the first microphone element configuration 121 and other microphone clusters 813-815 may transition into the second microphone element configuration 122. Thus, the microphone clusters 813-815 positioned near the center to laptop 800 (e.g., the microphone elements more likely to capture the user's voice) are activated, and the microphone clusters 811, 812, 816, 817 positioned towards the peripheral of the laptop 800 (e.g., the microphone clusters more likely to capture noise) are deactivated. As a result, the SNR of the captured audio may be relatively high because noise that would otherwise be captured by microphone elements in the microphone clusters 811, 812, 816, 817 is not captured.

Figure 9:
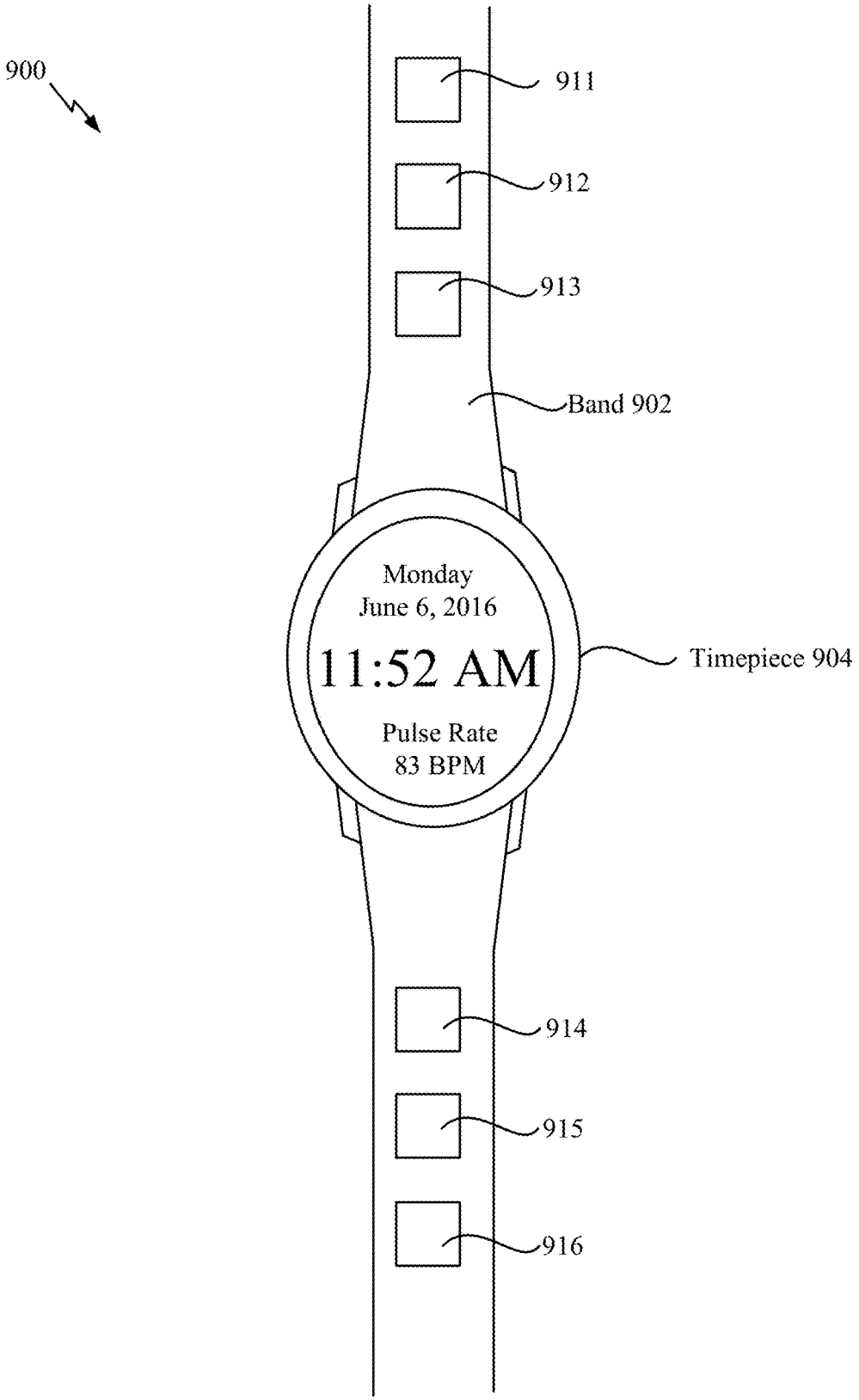
FIG. 9 is a diagram of a smart watch that is operable to perform the techniques described with reference to FIGS. 1-6.

Referring to FIG. 9, a smart watch 900 that is operable to detect audio using one or more microphone clusters is shown. The smart watch 900 includes a band 902 that is coupled to a timepiece 904. The timepiece 904 includes a screen that displays information (e.g., a day, a date, a time, a pulse rate, etc.) to a user.

The band 902 includes a microphone cluster 911, a microphone cluster 912, a microphone cluster 913, a microphone cluster 914, a microphone cluster 915, and a microphone cluster 916. The microphone clusters 911-916 may have the same configuration (and operate in a substantially similar manner) as the microphone clusters 104, 106, 108 of FIG. 1, the microphone clusters of FIGS. 2A-2E, or a combination thereof.

One or more of the microphone clusters 911-916 may be operable to detect a pulse of the user. For example, microphone elements within the microphone clusters 911-916 may capture ultrasound (or another acoustical frequency) associated with the pulse of the user. The pulse may be displayed on the screen of the timepiece 904. As illustrated in FIG. 9, the user has a pulse rate of 83 beats per minute (BPM).

According to some implementations, one or more of the microphone clusters 911-917 may have a similar configuration as the microphone cluster 108B of FIG. 2C. For example, one or more of the microphone clusters 911-917 may have dual acoustic port openings (e.g., a first acoustic port opening facing the top side of the smart watch 900 and a second acoustic port opening facing bottom side or inside of the smart watch 900). In such a scenario, microphone elements coupled to the second acoustic port opening may be deactivated in response to a determination that the smart watch 900 is being worn (e.g., a determination that the band 902 is attached to the user). For example, if a connector piece (e.g., a buckle) couples both portions of the band 902, the microphone elements coupled to the acoustic port openings touching the skin of the user may be deactivated to conserve energy. However, if the connection piece is not coupling both portions of the band 902, the microphone elements may be activated.

The foregoing techniques may be performed with respect to any number of different contexts and audio ecosystems. A number of example contexts are described below, although the techniques should be limited to the example contexts. One example audio ecosystem may include audio content, movie studios, music studios, gaming audio studios, channel based audio content, coding engines, game audio stems, game audio coding/rendering engines, and delivery systems.

The movie studios, the music studios, and the gaming audio studios may receive audio content. In some examples, the audio content may represent the output of an acquisition. The movie studios may output channel based audio content (e.g., in 2.0, 5.1, and 7.1) such as by using a digital audio workstation (DAW). The music studios may output channel based audio content (e.g., in 2.0, and 5.1) such as by using a DAW. In either case, the coding engines may receive and encode the channel based audio content based one or more codecs (e.g., AAC, AC3, Dolby True HD, Dolby Digital Plus, and DTS Master Audio) for output by the delivery systems. The gaming audio studios may output one or more game audio stems, such as by using a DAW. The game audio coding/rendering engines may code and or render the audio stems into channel based audio content for output by the delivery systems. Another example context in which the techniques may be performed includes an audio ecosystem that may include broadcast recording audio objects, professional audio systems, consumer on-device capture, HOA audio format, on-device rendering, consumer audio, TV, and accessories, and car audio systems.

The broadcast recording audio objects, the professional audio systems, and the consumer on-device capture may all code their output using HOA audio format. In this way, the audio content may be coded using the HOA audio format into a single representation that may be played back using the on-device rendering, the consumer audio, TV, and accessories, and the car audio systems. In other words, the single representation of the audio content may be played back at a generic audio playback system (i.e., as opposed to requiring a particular configuration such as 5.1, 7.1, etc.), such as audio playback system 16.

Other examples of context in which the techniques may be performed include an audio ecosystem that may include acquisition elements, and playback elements. The acquisition elements may include wired and/or wireless acquisition devices (e.g., Eigen microphones), on-device surround sound capture, and mobile devices (e.g., smartphones and tablets). In some examples, wired and/or wireless acquisition devices may be coupled to mobile device via wired and/or wireless communication channel(s).

In accordance with one or more techniques of this disclosure, the mobile device may be used to acquire a sound field. For instance, the mobile device may acquire a sound field via the wired and/or wireless acquisition devices and/or the on-device surround sound capture (e.g., a plurality of microphones integrated into the mobile device). The mobile device may then code the acquired sound field into the HOA coefficients for playback by one or more of the playback elements. For instance, a user of the mobile device may record (acquire a sound field of) a live event (e.g., a meeting, a conference, a play, a concert, etc.), and code the recording into HOA coefficients.

The mobile device may also utilize one or more of the playback elements to playback the HOA coded sound field. For instance, the mobile device may decode the HOA coded sound field and output a signal to one or more of the playback elements that causes the one or more of the playback elements to recreate the sound field. As one example, the mobile device may utilize the wireless and/or wireless communication channels to output the signal to one or more speakers (e.g., speaker arrays, sound bars, etc.). As another example, the mobile device may utilize docking solutions to output the signal to one or more docking stations and/or one or more docked speakers (e.g., sound systems in smart cars and/or homes). As another example, the mobile device may utilize headphone rendering to output the signal to a set of headphones, e.g., to create realistic binaural sound.

In some examples, a particular mobile device may both acquire a 3D sound field and playback the same 3D sound field at a later time. In some examples, the mobile device may acquire a 3D sound field, encode the 3D sound field into HOA, and transmit the encoded 3D sound field to one or more other devices (e.g., other mobile devices and/or other non-mobile devices) for playback.

Yet another context in which the techniques may be performed includes an audio ecosystem that may include audio content, game studios, coded audio content, rendering engines, and delivery systems. In some examples, the game studios may include one or more DAWs which may support editing of HOA signals. For instance, the one or more DAWs may include HOA plugins and/or tools which may be configured to operate with (e.g., work with) one or more game audio systems. In some examples, the game studios may output new stem formats that support HOA. In any case, the game studios may output coded audio content to the rendering engines which may render a sound field for playback by the delivery systems.

The techniques may also be performed with respect to exemplary audio acquisition devices. For example, the techniques may be performed with respect to an Eigen microphone which may include a plurality of microphones that are collectively configured to record a 3D sound field. In some examples, the plurality of microphones of Eigen microphone may be located on the surface of a substantially spherical ball with a radius of approximately 4 cm. In some examples, the audio encoding device 20 may be integrated into the Eigen microphone so as to output a bitstream 21 directly from the microphone.

Another exemplary audio acquisition context may include a production truck which may be configured to receive a signal from one or more microphones, such as one or more Eigen microphones. The production truck may also include an audio encoder, such as audio encoder 20.

The mobile device may also, in some instances, include a plurality of microphones that are collectively configured to record a 3D sound field. In other words, the plurality of microphone may have X, Y, Z diversity. In some examples, the mobile device may include a microphone which may be rotated to provide X, Y, Z diversity with respect to one or more other microphones of the mobile device. The mobile device may also include an audio encoder, such as audio encoder 20.

Example audio playback devices that may perform various aspects of the techniques described in this disclosure are further discussed below. In accordance with one or more techniques of this disclosure, speakers and/or sound bars may be arranged in any arbitrary configuration while still playing back a 3D sound field. Moreover, in some examples, headphone playback devices may be coupled to a decoder 24 via either a wired or a wireless connection. In accordance with one or more techniques of this disclosure, a single generic representation of a sound field may be utilized to render the sound field on any combination of the speakers, the sound bars, and the headphone playback devices.

A number of different example audio playback environments may also be suitable for performing various aspects of the techniques described in this disclosure. For instance, a 5.1 speaker playback environment, a 2.0 (e.g., stereo) speaker playback environment, a 9.1 speaker playback environment with full height front loudspeakers, a 22.2 speaker playback environment, a 16.0 speaker playback environment, an automotive speaker playback environment, and a mobile device with ear bud playback environment may be suitable environments for performing various aspects of the techniques described in this disclosure.

In accordance with one or more techniques of this disclosure, a single generic representation of a sound field may be utilized to render the sound field on any of the foregoing playback environments. Additionally, the techniques of this disclosure enable a rendered to render a sound field from a generic representation for playback on the playback environments other than that described above. For instance, if design considerations prohibit proper placement of speakers according to a 7.1 speaker playback environment (e.g., if it is not possible to place a right surround speaker), the techniques of this disclosure enable a render to compensate with the other 6 speakers such that playback may be achieved on a 6.1 speaker playback environment.

Moreover, a user may watch a sports game while wearing headphones. In accordance with one or more techniques of this disclosure, the 3D sound field of the sports game may be acquired (e.g., one or more Eigen microphones may be placed in and/or around the baseball stadium), HOA coefficients corresponding to the 3D sound field may be obtained and transmitted to a decoder, the decoder may reconstruct the 3D sound field based on the HOA coefficients and output the reconstructed 3D sound field to a renderer, the renderer may obtain an indication as to the type of playback environment (e.g., headphones), and render the reconstructed 3D sound field into signals that cause the headphones to output a representation of the 3D sound field of the sports game.

It should be noted that various functions performed by the one or more components of the systems and devices disclosed herein are described as being performed by certain components or modules. This division of components and modules is for illustration only. In an alternate implementation, a function performed by a particular component or module may be divided amongst multiple components or modules. Moreover, in an alternate implementation, two or more components or modules may be integrated into a single component or module. Each component or module may be implemented using hardware (e.g., a field-programmable gate array (FPGA) device, an application-specific integrated circuit (ASIC), a DSP, a controller, etc.), software (e.g., instructions executable by a processor), or any combination thereof.

Those of skill would further appreciate that the various illustrative logical blocks, configurations, modules, circuits, and algorithm steps described in connection with the implementations disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the implementations disclosed herein may be embodied directly in hardware, in a software module executed by a processor, or in a combination of the two. A software module may reside in a memory device, such as random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an application-specific integrated circuit (ASIC). The ASIC may reside in a computing device or a user terminal. In the alternative, the processor and the storage medium may reside as discrete components in a computing device or a user terminal.

The previous description of the disclosed implementations is provided to enable a person skilled in the art to make or use the disclosed implementations. Various modifications to these implementations will be readily apparent to those skilled in the art, and the principles defined herein may be applied to other implementations without departing from the scope of the disclosure. Thus, the present disclosure is not intended to be limited to the implementations shown herein but is to be accorded the widest scope possible consistent with the principles and novel features as defined by the following claims.

What is claimed is:

1. A microphone device comprising:

a microphone array configured to capture one or more audio objects associated with a three-dimensional sound field, the microphone array comprising multiple clusters of two or more microphone elements, each cluster of the multiple clusters comprising one or more acoustic port openings and two or more microphone elements coupled to the one or more acoustic port openings via corresponding acoustic ports; and a processor coupled to the microphone array and configured to process the one or more captured audio objects and perform an activation operation associated with a microphone element or cluster, a deactivation operation associated with the microphone element or cluster, or a configuration change operation associated with the microphone element or cluster.

2. The microphone device of claim 1, further comprising:

a first cluster of microphone elements integrated into the microphone array, the first cluster comprising:

a first microphone element coupled to a first acoustic port opening via a first acoustic port;

and a second microphone element coupled to the first acoustic port opening via a second acoustic port.

3. The microphone device of claim 2, wherein the first acoustic port and the second acoustic port have a similar length.

4. The microphone device of claim 3, wherein a length of the first acoustic port is between five millimeters and ten millimeters.

5. The microphone device of claim 2, further comprising:

a first analog-to-digital converter coupled to the first microphone element; and a second analog-to-digital converter coupled to the second microphone element.

6. The microphone device of claim 2, wherein the first cluster is configured to:

capture, at the first microphone element via the first acoustic port, first audio based on first soundwaves of an audio signal received at the first acoustic port opening; and capture, at the second microphone element via the second acoustic port, second audio based on second soundwaves of the audio signal, the second soundwaves having similar properties as the first soundwaves.

7. The microphones device of claim 6, wherein the first microphone element and the second microphone element are configured to capture corresponding audio at the same time.

8. The microphone device of claim 7, wherein the first cluster is configured to amplify the audio signal in response to each microphone element of the first cluster capturing the corresponding audio at the same time.

9. The microphone device of claim 6, wherein the first cluster is configured to improve a gain of the audio signal compared to a cluster having a single microphone element for each acoustic port opening.

10. The microphone device of claim 1, wherein an acoustic port opening of a first cluster of the multiple clusters differs from an acoustic port opening of a second cluster of the multiple clusters.

11. The microphone device of claim 1, further comprising a package including one or more microphone elements, wherein the package comprises a microelectromechanical system (MEMS) package.

12. The microphone device of claim 11, wherein the MEMS package comprises two or more microphone elements.

13. The microphone device of claim 1, further comprising:

a first cluster of microphone elements integrated into the microphone array, the first cluster comprising:

a first microphone element coupled to a first acoustic port opening via a first acoustic port; and a second microphone element coupled to a second acoustic port opening via a second acoustic port, the second acoustic port opening associated with a different housing than the first acoustic port opening.

14. The microphone device of claim 13, wherein a housing associated with the first acoustic port opening is orthogonal to a housing associated with the second acoustic port opening.

15. The microphone device of claim 13, wherein a housing associated with the first acoustic port opening is positioned on an opposite side of the first microphone element and the second microphone element as a housing associated with the second acoustic port opening.

16. The microphone device of claim 1, further comprising:

a first cluster of microphone elements integrated into the microphone array, the first cluster comprising:

a first microphone element coupled to a first acoustic port opening via a first acoustic port; and a second microphone element coupled to the first acoustic port opening via a second acoustic port, the first microphone element and the second microphone element included in a first microelectromechanical system (MEMS) package; and a second cluster of microphone elements integrated into the microphone array, the second cluster comprising:

a third microphone element coupled to a second acoustic port opening via a third acoustic port; and a fourth microphone element coupled to the second acoustic port opening via a fourth acoustic port, the third microphone element and the fourth microphone element included in a second MEMS package.

17. The microphone device of claim 1, further comprising:

a first cluster of microphone elements integrated into the microphone array;

a second cluster of microphone elements integrated into the microphone array; and an acoustic port opening that is shared by the first cluster of microphone elements and the second cluster of microphone elements.

18. The microphone device of claim 1, further comprising a laptop, wherein the microphone array is coupled to the laptop.

19. The microphone device of claim 1, further comprising a smart watch, wherein the microphone array is coupled to a band of the smart watch.

20. The microphone device of claim 1, wherein the microphone array has a spherical geometry, a linear geometry, or a circular geometry, and wherein the processor is further configured to deactivate at least one of the multiple clusters based on data throughput associated with the microphone array failing to satisfy a data throughput threshold.

21. A method comprising:

capturing, at a microphone array, one or more audio objects associated with a three-dimensional sound field, the microphone array comprising multiple clusters of two or more microphone elements, each cluster of the multiple clusters comprising one or more acoustic port openings and two or more microphone elements coupled to the one or more acoustic port openings via corresponding acoustic ports; and performing, at a processor: an activation operation associated with a microphone element or cluster and processing the one or more captured audio objects.

22. The method of claim 21, further comprising:

receiving an audio signal at a first acoustic port opening, the first acoustic port opening associated with a first cluster of microphone elements integrated into the microphone array; and deactivating the first cluster based on a signal-to-noise ratio associated with the audio signal and the first cluster.

23. The method of claim 22, further comprising:

capturing, at a first microphone element via a first acoustic port, first audio based on first soundwaves of the audio signal received at the first acoustic port opening; and capturing, at a second microphone element via a second acoustic port, second audio based on second soundwaves of the audio signal, the second soundwaves having similar properties as the first soundwaves.

24. The method of claim 23, wherein the first acoustic port and the second acoustic port have a similar length.

25. The method of claim 24, wherein a length of the first acoustic port is between five millimeters and ten millimeters.

26. The method of claim 23, further comprising:

converting, at a first analog-to-digital converter, the first audio to a first digital signal; and converting, at a second analog-to-digital converter, the second audio to a second digital signal.

27. An apparatus comprising:

means for capturing one or more audio objects associated with a three-dimensional sound field, the means for capturing comprising multiple clusters of two or more microphone elements, each cluster of the multiple clusters comprising one or more acoustic port openings and two or more microphone elements coupled to the one or more acoustic port openings via corresponding acoustic ports; and means for processing the one or more captured audio objects, the means for processing configured to perform a deactivation operation associated with a microphone element or cluster.

28. The apparatus of claim 27, further comprising a laptop, wherein the means for capturing is integrated into the laptop.

29. A microphone device comprising:

a microphone array configured to capture one or more audio objects associated with a three-dimensional sound field, the microphone array comprising:

a first cluster of two or more microphone elements;

a second cluster of two or more microphone elements; and an acoustic port opening that is shared by the first cluster and the second cluster; and a processor coupled to the microphone array and configured to: process the one or more captured audio objects and perform a configuration change operation associated with a microphone element or cluster.

30. The microphone device of claim 29, further comprising a smart watch, wherein the microphone array is integrated into a band of the smart watch.

* * * * *